US010378469B2

(12) United States Patent
Insixiengmai

(10) Patent No.: US 10,378,469 B2
(45) Date of Patent: Aug. 13, 2019

(54) EVAPORATED FUEL TREATING DEVICE AND VEHICLE

(71) Applicant: TOYOTA JIDOSHA KABUSHIKI KAISHA, Toyota-shi, Aichi-ken (JP)

(72) Inventor: Leuth Insixiengmai, Nagoya (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 15/889,550

(22) Filed: Feb. 6, 2018

(65) Prior Publication Data

US 2018/0230926 A1 Aug. 16, 2018

(30) Foreign Application Priority Data

Feb. 13, 2017 (JP) ..... 2017-024121

(51) Int. Cl.

| | |
|---|---|
| ***F02M 25/08*** | (2006.01) |
| ***F02D 41/22*** | (2006.01) |
| *F02D 41/00* | (2006.01) |
| *F02D 41/20* | (2006.01) |

(52) U.S. Cl.

CPC ..... *F02D 41/22* (2013.01); *F02M 25/0836* (2013.01); *F02D 41/004* (2013.01); *F02D 2041/2027* (2013.01); *F02M 25/0809* (2013.01); *F02M 25/0854* (2013.01)

(58) Field of Classification Search

CPC ..... F02M 25/0809; F02M 25/0854; F02M 25/0836; F02D 41/004; F02D 2041/2027

See application file for complete search history.

(56) References Cited

U.S. PATENT DOCUMENTS

| | | | | |
|---|---|---|---|---|
| 5,447,141 | A | 9/1995 | Kitamoto et al. | |
| 5,476,083 | A * | 12/1995 | Blumenstock | B60K 15/03504 123/520 |
| 5,629,477 | A * | 5/1997 | Ito | F02D 41/22 123/518 |
| 5,718,210 | A * | 2/1998 | Ito | F02M 25/0809 123/198 D |
| 7,367,326 | B2 * | 5/2008 | Shikama | F02M 25/0809 123/198 D |

(Continued)

FOREIGN PATENT DOCUMENTS

| | | |
|---|---|---|
| JP | H07-030353 U | 6/1995 |
| JP | H10-009065 A | 1/1998 |

(Continued)

*Primary Examiner* — Thomas N Moulis

(74) *Attorney, Agent, or Firm* — Oliff PLC

(57) ABSTRACT

An evaporated fuel treating device includes a canister, a first purge passage connected to the canister, a second purge passage connected to a second end of the first purge passage and an intake passage, a purge control valve disposed in the first purge passage, a pulsation detection sensor disposed in the second purge passage, and an electronic control unit configured to execute abnormality detection control that detects abnormality of the second purge passage. The electronic control unit is configured to detect pulsation of a purge gas flowing through the second purge passage, based on an output signal from the pulsation detection sensor when the electronic control unit execute a control that opens and closes the purge control valve, and determine abnormality of the second purge passage, based on the detected pulsation.

8 Claims, 9 Drawing Sheets

(56) References Cited

U.S. PATENT DOCUMENTS

| | | | | |
|---|---|---|---|---|
| 9,243,592 | B2 * | 1/2016 | Dudar | F02M 25/0818 |
| 2004/0094133 | A1 | 5/2004 | Lingenhult et al. | |
| 2006/0179928 | A1 * | 8/2006 | Shikama | F02M 25/0809 73/114.39 |
| 2009/0183500 | A1 | 7/2009 | Uchida et al. | |
| 2010/0224171 | A1 * | 9/2010 | Peters | F02M 25/0836 123/520 |
| 2012/0211087 | A1 * | 8/2012 | Dudar | F02D 41/0032 137/12 |
| 2016/0010570 | A1 | 1/2016 | Miyazaki et al. | |
| 2016/0069304 | A1 * | 3/2016 | Guidi | F02M 25/0809 123/518 |
| 2016/0258390 | A1 | 9/2016 | Makino | |
| 2017/0129329 | A1 * | 5/2017 | Tochihara | F02M 35/10222 |
| 2017/0276078 | A1 * | 9/2017 | Imaizumi | F02B 37/16 |
| 2018/0223762 | A1 * | 8/2018 | Insixiengmai | F02D 41/0037 |
| 2018/0291830 | A1 * | 10/2018 | Kurosawa | F02M 25/08 |

FOREIGN PATENT DOCUMENTS

| | | | |
|---|---|---|---|
| JP | 2007-023925 | A | 2/2007 |
| JP | 2009-162203 | A | 7/2009 |
| JP | 2009-167962 | A | 7/2009 |
| JP | 4350660 | B2 | 10/2009 |
| JP | 2016-017493 | A | 2/2016 |
| JP | 2016-164386 | A | 9/2016 |

* cited by examiner

EVAPORATED FUEL TREATING DEVICE AND VEHICLE

INCORPORATION BY REFERENCE

The disclosure of Japanese Patent Application No. 2017-024121 filed on Feb. 13, 2017 including the specification, drawings and abstract is incorporated herein by reference in its entirety.

BACKGROUND

1. Technical Field

The disclosure relates to an evaporated fuel treating device and a vehicle.

2. Description of Related Art

Japanese Unexamined Patent Application Publication No. 2009-162203 (JP 2009-162203 A) discloses an evaporated fuel treating device that supplies a purge gas containing evaporated fuel generated in a fuel tank to a combustion chamber of an internal combustion engine to burn the purge gas in the combustion chamber. The evaporated fuel treating device has a canister for adsorbing the evaporated fuel generated in the fuel tank, a first purge passage having a first end connected to the canister, and a second purge passage connected to a second end of the first purge passage. The internal combustion engine described in JP 2009-162203 A is a V-type internal combustion engine having two banks. An intake passage of the internal combustion engine is branched at a downstream end portion on the bank side. At the downstream end portion of the intake passage, the branched portion on one side configures a first intake passage connected to a first bank, and the branched portion on the other side configures a second intake passage connected to a second bank. In the evaporated fuel treating device, the second purge passage is composed of two passages; a first branch passage and a second branch passage. The first branch passage is connected to the first intake passage, and the second branch passage is connected to the second intake passage. A first purge control valve is provided on the pathway of the first branch passage. A second purge control valve is provided on the pathway of the second branch passage. In the evaporated fuel treating device, the first purge control valve or the second purge control valve is driven to be opened and closed, whereby a negative pressure in the intake passage is introduced into the canister through the first purge passage and the second purge passage, and the purge gas flows toward the combustion chamber of the internal combustion engine.

SUMMARY

In the evaporated fuel treating device, a case where the second purge passage through which the purge gas flows is clogged or disengaged, so that the purge gas cannot appropriately flow to the intake passage, is also conceivable. In JP 2009-162203 A, there is no disclosure regarding the occurrence of such abnormality. In the evaporated fuel treating device, from the viewpoint of appropriate treatment of the purge gas, it is desired to detect the occurrence of abnormality in the purge passage.

A first aspect of the disclosure relates to an evaporated fuel treating device including a canister, a first purge passage, a second purge passage, a purge control valve, a pulsation detection sensor, an electronic control unit. The canister is configured to adsorb evaporated fuel generated in a fuel tank. The first purge passage has a first end connected to the canister. The second purge passage is connected to a second end of the first purge passage and makes the first purge passage and an intake passage communicate with each other. The purge control valve is disposed in the first purge passage. The pulsation detection sensor is disposed in the second purge passage. The electronic control unit is configured to execute abnormality detection control that performs abnormality detection of the second purge passage. The electronic control unit is configured to execute control that opens and closes the purge control valve. The electronic control unit is configured to detect pulsation of a purge gas flowing through the second purge passage, based on an output signal from the pulsation detection sensor when the electronic control unit executes the control that opens and closes the purge control valve. The electronic control unit is configured to determine abnormality of the second purge passage, based on the detected pulsation of the purge gas.

According to the first aspect of the disclosure, the pulsation of the purge gas in the second purge passage when the purge control valve is driven to be opened and closed is detected. When the purge control valve is driven to be opened, the purge gas flows from the canister to the intake passage through the first purge passage and the second purge passage. When the purge control valve is driven to be closed, the flow of the purge gas through the first purge passage and the second purge passage is stopped. For this reason, when abnormality such as clogging or disengagement does not occur in the second purge passage, the pulsation of the purge gas occurs in the second purge passage due to the flow of the purge gas associated with the opening and closing drive of the purge control valve. On the other hand, if abnormality occurs in the second purge passage, even if the purge control valve is driven to be opened and closed, it is difficult for a change to occur in the flow of the purge gas in the second purge passage. For this reason, it becomes difficult for the pulsation of the purge gas to occur in the second purge passage. Therefore, as in the above configuration, based on the pulsation of the purge gas in the second purge passage when the purge control valve is driven to be opened and closed, it becomes possible to detect the occurrence of abnormality in the second purge passage in the evaporated fuel treating device.

In the first aspect of the disclosure, the second purge passage may have a plurality of branch passages. Each of the branch passages may have one end that is connected to the second end of the first purge passage and the other end that is connected to the intake passage. A check valve and the pulsation detection sensor may be provided in each of the branch passages. The check valve may be configured to allow a flow of the purge gas toward the intake passage side and limit the flow of the purge gas toward the first purge passage side. The pulsation detection sensor may be disposed further on the intake passage side than the check valve. The electronic control unit may be configured to detect pulsation of the purge gas in each of the branch passages, based on an output signal from the pulsation detection sensor when the electronic control unit executes the control that opens and closes the purge control valve. The electronic control unit may be configured to determine abnormality in each of the branch passages, based on the detected pulsation of the purge gas in each of the branch passages.

According to the first aspect of the disclosure, the check valve is provided in each of the branch passages. For this reason, even in a case where the second purge passage is configured of a plurality of branch passages, it is possible to restrain intake air flowing in from the intake passage from flowing between the branch passages. In each of the branch passages, the pulsation detection sensor is provided further on the intake passage side than the check valve, and therefore, in a case where the second purge passage is configured of a plurality of branch passages, it also becomes possible to detect the occurrence of abnormality in each of the branch passages.

In the first aspect of the disclosure, the electronic control unit may include a bandpass filter configured to pass solely an output signal having a frequency range corresponding to a frequency of an opening and closing drive signal of the purge control valve, among output signals from the pulsation detection sensor.

According to the first aspect of the disclosure, in the electronic control unit, it is possible to extract solely an output signal having a frequency range corresponding to the frequency of the opening and closing drive signal of the purge control valve, among the output signals from the pulsation detection sensor. For this reason, it is possible to remove the influence or the like of noise or disturbance of the pulsation detection sensor which is not related to the frequency of the drive signal, and thus it becomes possible to detect the pulsation of the purge gas reflecting solely the influence of the opening and closing drive of the purge control valve. Therefore, when the occurrence of abnormality in the second purge passage is detected based on the pulsation of the purge gas, it is possible to improve the detection accuracy of abnormality occurrence.

In the first aspect of the disclosure, the electronic control unit may be configured to calculate a front-side pressure that is a pressure further on the canister side than the purge control valve in the first purge passage. The electronic control unit may be configured to calculate a rear-side pressure that is a pressure further on the second purge passage side than the purge control valve in the first purge passage. The electronic control unit may be configured to start the abnormality detection control when the electronic control unit determines that a differential pressure between the calculated front-side pressure and the calculated rear-side pressure is equal to or higher than a predetermined pressure.

According to the first aspect of the disclosure, the abnormality detection control is started when the front-rear differential pressure in the purge control valve is equal to or higher than a predetermined pressure. For this reason, the flow of the purge gas easily changes due to the opening and closing drive of the purge control valve, and it is possible to perform abnormality detection when the pulsation of the purge gas is easy to occur in the second purge passage. Therefore, the detection of the pulsation of the purge gas in the electronic control unit becomes easy.

In the first aspect of the disclosure, the electronic control unit may be configured to open and close the purge control valve by controlling a duty ratio of a drive signal to the purge control valve and may be configured to determine whether to execute the abnormality detection control according to the duty ratio.

According to the first aspect of the disclosure, when the duty ratio is extremely low or extremely high, for example, even if the purge control valve is driven to be opened and closed, the difference between an opening time and a closing time of the purge control valve becomes larger than usual, and thus it is difficult for the pulsation of the purge gas to occur in the second purge passage. In the above configuration, since whether to execute the abnormality detection control is determined according to the duty ratio, it is possible to perform abnormality detection in a situation where the pulsation of the purge gas is easy to occur in the second purge passage. Therefore, the detection of the pulsation of the purge gas in the electronic control unit becomes easy.

In the first aspect of the disclosure, the electronic control unit may be configured to calculate a front-side pressure that is a pressure further on the canister side than the purge control valve in the first purge passage. The electronic control unit may be configured to calculate a rear-side pressure that is a pressure further on the second purge passage side than the purge control valve in the first purge passage. The electronic control unit may be configured to determine that the second purge passage is in abnormal state, when an amplitude of the detected pulsation of the purge gas is equal to or less than a determination value. The determination value may be set to be larger as the differential pressure between the calculated front-side pressure and the calculated rear-side pressure becomes larger.

According to the first aspect of the disclosure, the amplitude of the pulsation of the purge gas in the second purge passage associated with the opening and closing drive of the purge control valve becomes larger as the front-rear differential pressure in the purge control valve is larger. For this reason, the difference between the amplitude of the pulsation of the purge gas in the second purge passage in a normal state and the amplitude of the pulsation of the purge gas in the second purge passage in an abnormal state becomes larger as the front-rear differential pressure in the purge control valve is larger. In the above configuration, the determination value of the amplitude relating to the abnormality determination is set to be larger as the front-rear differential pressure in the purge control valve becomes larger. For this reason, erroneous determination is suppressed at the time of the abnormality determination, and thus it is possible to enhance the detection accuracy of abnormality occurrence.

In the first aspect of the disclosure, the electronic control unit may be configured to execute the control that opens and closes the purge control valve by controlling a duty ratio of a drive signal to the purge control valve. The electronic control unit may be configured to determine that the second purge passage is in abnormal state, when the amplitude of the detected pulsation of the purge gas is equal to or less than a determination value. The determination value may become the largest value when the duty ratio is a predetermined ratio, and become a smaller value as the duty ratio deviates from the predetermined ratio.

According to the first aspect of the disclosure, the amplitude of the pulsation of the purge gas in the second purge passage associated with the opening and closing drive of the purge control valve becomes the maximum when the duty ratio is a predetermined ratio, and tends to become smaller as the duty ratio deviates from the predetermined ratio. For this reason, the difference between the amplitude of the pulsation of the purge gas in the second purge passage in a normal state and the amplitude of the pulsation of the purge gas in the second purge passage in an abnormal state is the maximum when the duty ratio is the predetermined ratio, and becomes smaller as the duty ratio deviates from the predetermined ratio. In the above configuration, the determination value of the amplitude relating to the abnormality determination becomes the largest value when the duty ratio is the predetermined ratio, and becomes a smaller value as the duty ratio deviates from the predetermined ratio. For this reason, erroneous determination is suppressed at the time of the abnormality determination, and thus it is possible to enhance the abnormality detection accuracy.

A second aspect of the disclosure relates to a vehicle including an internal combustion engine and an evaporated fuel treating device. The evaporated fuel treating device includes a canister, a first purge passage, a second purge passage, a purge control valve, a pulsation detection sensor, and an electronic control unit. The canister is configured to adsorb evaporated fuel generated in a fuel tank, the first purge passage has a first end connected to the canister, and the second purge passage is connected to a second end of the first purge passage and makes the first purge passage and an intake passage communicate with each other. The purge control valve is disposed in the first purge passage, and the pulsation detection sensor is disposed in the second purge passage. The electronic control unit is configured to start abnormality detection control when an operation state of the internal combustion engine is in an idle operation. The electronic control unit is configured to execute control that opens and closes the purge control valve. The electronic control unit is configured to detect pulsation of a purge gas flowing through the second purge passage, based on an output signal from the pulsation detection sensor when the electronic control unit executes the control that opens and closes the purge control valve is executed. The electronic control unit is configured to determine abnormality of the second purge passage, based on the detected pulsation of the purge gas.

According to the second aspect of the disclosure, abnormality determination processing is started during an idle operation in which a negative pressure in the intake passage becomes larger. The negative pressure in the intake passage is introduced further toward the intake passage side than the purge control valve in the first purge passage, and therefore, the front-rear differential pressure in the purge control valve becomes large during the idle operation.

According to the first and second aspects of the disclosure, the abnormality detection control can be executed when the flow of the purge gas is easy to change due to the opening and closing drive of the purge control valve. Therefore, it is possible to support the accuracy of abnormality detection of the second purge passage.

BRIEF DESCRIPTION OF THE DRAWINGS

Features, advantages, and technical and industrial significance of exemplary embodiments will be described below with reference to the accompanying drawings, in which like numerals denote like elements, and wherein.

DETAILED DESCRIPTION OF EMBODIMENTS

Figure 1:
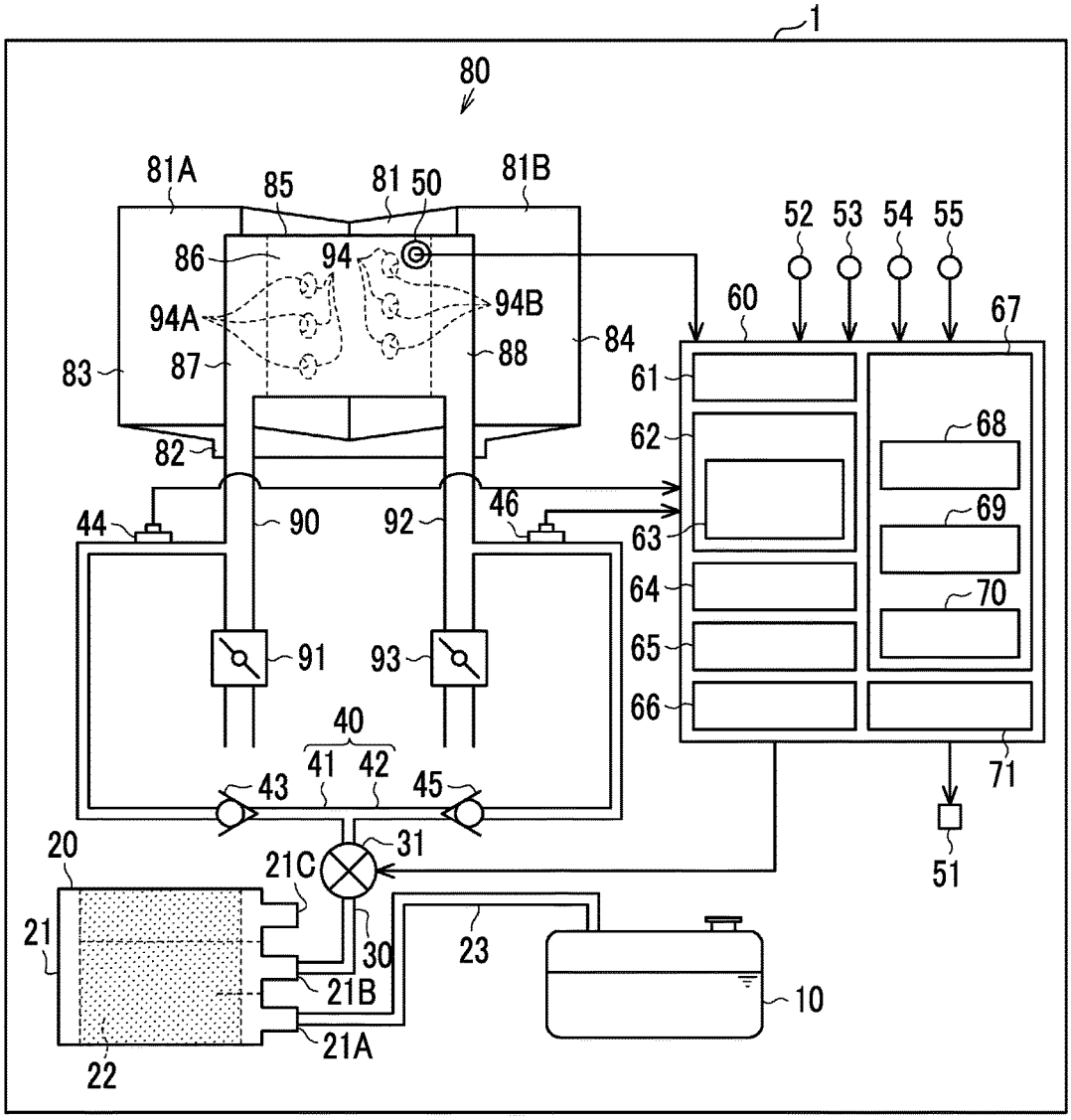
FIG. 1 is a schematic diagram showing a schematic configuration of an evaporated fuel treating device.

An embodiment of an evaporated fuel treating device will be described with reference to FIGS. 1 to 5. As shown in FIG. 1, a vehicle 1 is equipped with an evaporated fuel treating device and an internal combustion engine 80. The evaporated fuel treating device has a canister 20 configured to adsorb the evaporated fuel generated in a fuel tank 10. The canister 20 has a box-shaped case 21. An adsorbent 22 made of, for example, activated carbon or the like is accommodated in the case 21. The case 21 is provided with a first opening portion 21A, a second opening portion 21B, and a third opening portion 21C that make the inside and the outside of the case 21 communicate with each other. A first end of a communication passage 23 is connected to the first opening portion 21A. A second end of the communication passage 23 is connected to an upper end portion of the fuel tank 10. A first end of a first purge passage 30 is connected to the second opening portion 21B of the canister 20. The third opening portion 21C of the canister 20 is open to the atmosphere.

A purge control valve 31 is provided on the pathway of the first purge passage 30. The purge control valve 31 is an electromagnetic valve and is driven to be opened and closed according to the energized state of the electromagnetic valve. A second purge passage 40 is connected to a second end of the first purge passage 30. The second purge passage 40 is configured of two branch passages; a first branch passage 41 and a second branch passage 42. Each of the branch passages 41, 42 has a first end connected to the second end of the first purge passage 30, and a second end connected to an intake passage of the internal combustion engine 80.

The internal combustion engine 80 is a V-type internal combustion engine having a first bank 81A and a second bank 81B. That is, an engine main body 81 of the internal combustion engine 80 has a cylinder block 82, and a first cylinder head 83 and a second cylinder head 84 connected to an upper end portion of the cylinder block 82. The first cylinder head 83 and the second cylinder head 84 extend upwardly so as to form a V shape with respect to one another. The first bank 81A is configured of the first cylinder head 83 and the cylinder block 82. Three combustion chambers (not shown) are provided side by side in a cylinder array direction (an up-and-down direction in FIG. 1) in the first bank 81A. The second bank 81B is configured of the second cylinder head 84 and the cylinder block 82. Three combustion chambers (not shown) are provided side by side in a cylinder array direction (the up-and-down direction in FIG. 1) in the second bank 81B. The internal combustion engine 80 is also provided with a surge tank 85 that is one constituent member of the intake passage. The surge tank 85 is disposed at a position close to an upper portion of the engine main body 81 of the internal combustion engine 80. The surge tank 85 has a merging part 86 disposed in a central portion of the surge tank 85. A first introduction part 87 is connected to a first end (a left end in FIG. 1) of the merging part 86. The merging part 86 and the first introduction part 87 communicate with each other. A second introduction part 88 is connected to a second end (a right end in FIG. 1) of the merging part 86. The merging part 86 and the second introduction part 88 communicate with each other.

A first intake pipe 90 that is one constituent member of the intake passage is connected to the first introduction part 87 of the surge tank 85. Intake air is introduced into the surge tank 85 through the first intake pipe 90. A first throttle valve 91 is disposed in the first intake pipe 90. The amount of the intake air flowing through the first intake pipe 90 is adjusted by the first throttle valve 91. A second intake pipe 92 that is one constituent member of the intake passage is connected to the second introduction part 88 of the surge tank 85. Intake air is introduced into the surge tank 85 through the second intake pipe 92 as well. A second throttle valve 93 is disposed in the second intake pipe 92. The amount of the intake air flowing through the second intake pipe 92 is adjusted by the second throttle valve 93.

A first end of each of a plurality of branch pipes 94 is connected to the merging part 86 of the surge tank 85. The branch pipes 94 include three first branch pipes 94A provided side by side on the first bank 81A side (the left side in FIG. 1), and three second branch pipes 94B provided side by side on the second bank 81B side (the right side in FIG. 1). A second end of each of the first branch pipes 94A is connected to the first cylinder head 83, and the first branch pipes 94A communicate with the combustion chambers provided in the first bank 81A. A second end of each of the second branch pipes 94B is connected to the second cylinder head 84, and the second branch pipes 94B communicate with the combustion chambers provided in the second bank 81B. The intake air that has flowed from the first intake pipe 90 to the first introduction part 87 merges with the intake air that has flowed from the second intake pipe 92 to the second introduction part 88 in the merging part 86 of the surge tank 85. Then, the intake air merged in the merging part 86 is supplied to each combustion chamber of the engine main body 81 through each of the branch pipes 94. A negative pressure sensor 50 for detecting the pressure in the merging part 86 is provided in the merging part 86.

The second end of the first branch passage 41 is connected further to the intake downstream side than the first throttle valve 91 in the first intake pipe 90. In this way, the second end of the first purge passage 30 communicates with the first intake pipe 90. A first check valve 43 is provided on the pathway of the first branch passage 41. The first check valve 43 is a pressure-sensitive check valve. When the pressure on the first end side (the first purge passage 30 side) of the first branch passage 41 is higher than the pressure on the second end side (the first intake pipe 90 side), the first check valve 43 is opened to allow the flow of the purge gas toward the first intake pipe 90 side. On the other hand, when the pressure on the first end side of the first branch passage 41 is equal to or lower than the pressure on the second end side, the first check valve 43 is closed to restrict the flow of the purge gas toward the first purge passage 30 side. A first pressure sensor 44 as a pulsation detection sensor is provided in the first branch passage 41 further on the first intake pipe 90 side than the first check valve 43.

The second end of the second branch passage 42 is connected further to the intake downstream side than the second throttle valve 93 in the second intake pipe 92. In this way, the second end of the first purge passage 30 also communicates with the second intake pipe 92. A second check valve 45 is provided on the pathway of the second branch passage 42. The second check valve 45 is a pressure-sensitive check valve, similar to the first check valve 43. When the pressure on the first end side (the first purge passage 30 side) of the second branch passage 42 is higher than the pressure on the second end side (the second intake pipe 92 side), the second check valve 45 is opened to allow the flow of the purge gas toward the second intake pipe 92 side. On the other hand, when the pressure on the first end side of the second branch passage 42 is equal to or lower than the pressure on the second end side, the second check valve 45 is closed to restrict the flow of the purge gas toward the first purge passage 30 side. A second pressure sensor 46 as a pulsation detection sensor is provided in the second branch passage 42 further on the second intake pipe 92 side than the second check valve 45.

When evaporated fuel is generated in the fuel tank 10, the pressure in the fuel tank 10 increases. For this reason, a fluid gas that includes the evaporated fuel and the air in the fuel tank 10 flow into the case 21 of the canister 20 through the communication passage 23. The fluid gas passes through the adsorbent 22 in the case 21, whereby the evaporated fuel included in the fluid gas is adsorbed to the adsorbent 22. The fluid gas having passed through the adsorbent 22, from which the evaporated fuel has been removed, is discharged to the atmosphere through the third opening portion 21C. The fluid gas flows as described above, whereby the evaporated fuel that is generated in the fuel tank 10 is collected by the canister 20.

The evaporated fuel collected by the canister 20 is supplied to the combustion chamber of the internal combustion engine 80 in the following manner. That is, when the engine main body 81 of the internal combustion engine 80 is driven, a negative pressure is generated in the intake passage configured of the first intake pipe 90, the second intake pipe 92, and the surge tank 85. If the negative pressure is introduced into the first branch passage 41, the pressure on the first end side (the first purge passage 30 side) in the first branch passage 41 becomes higher than the pressure on the second end side (the first intake pipe 90 side), and thus the first check valve 43 is opened. If the negative pressure is introduced into the second branch passage 42, the pressure on the first end side (the first purge passage 30 side) in the second branch passage 42 becomes higher than the pressure on the second end side (the second intake pipe 92 side), and thus the second check valve 45 is opened. If the first check valve 43 and the second check valve 45 are opened, air flows from the first branch passage 41 to the first intake pipe 90 and air flows from the second branch passage 42 to the second intake pipe 92. For this reason, in a state where the purge control valve 31 provided in the first purge passage 30 is closed, a rear-side pressure that is the pressure further on the second purge passage 40 side than the purge control valve 31 in the first purge passage 30 becomes equal to the negative pressure in the intake passage, that is, the surge tank 85. Then, when the rear-side pressure and the negative pressure in the surge tank 85 become equal to each other, the pressure on the first end side in the first branch passage 41 becomes equal to the pressure in the second end side and the pressure in the first end side in the second branch passage 42 becomes equal to the pressure in the second end side. For this reason, both the first check valve 43 and the second check valve 45 transition from an open state to a closed state. Since the canister 20 is open to the atmosphere through the third opening portion 21C, a front-side pressure that is the pressure in the first purge passage 30 further on the canister 20 side than the purge control valve 31 becomes equal to the atmospheric pressure. Therefore, a differential pressure is generated between the front and the rear of the purge control valve 31.

Thereafter, if the purge control valve 31 is opened, the canister 20 and each of the branch passages 41, 42 communicates with each other through the first purge passage 30. Since the pressure in the canister 20 open to the atmosphere is higher than the pressure in each of the intake pipes 90, 92, the pressure on the first end side of the first branch passage 41 becomes higher than the pressure on the second end side and the pressure on the first end side of the second branch passage 42 becomes higher than the pressure on the second end side. For this reason, the first check valve 43 and the second check valve 45 enter an open state. Air flowing into the case 21 through the third opening portion 21C of the canister 20 passes through the adsorbent 22 and is then discharged from the second opening portion 21B to the first purge passage 30. When air passes through the adsorbent 22, the evaporated fuel captured by the adsorbent 22 is separated from the adsorbent 22 and mixed into the air. For this reason, a gas that is discharged from the canister 20 to the first purge passage 30 becomes the purge gas that includes air and evaporated fuel. The purge gas flows from the first purge passage 30 to the first branch passage 41 and the second branch passage 42. The purge gas flowing to the first branch passage 41 passes through the first check valve 43, flows to the first intake pipe 90, and flows into the surge tank 85 together with the intake air. The purge gas flowing to the second branch passage 42 passes through the second check valve 45, flows to the second intake pipe 92, and flows into the surge tank 85 together with the intake air. Then, the purge gas is supplied to each combustion chamber through each of the branch pipes 94. The evaporated fuel treating device is also provided with an information lamp 51 for informing the driver of the occurrence of abnormality in the second purge passage 40.

The evaporated fuel treating device also has an electronic control unit 60. Output signals from the negative pressure sensor 50, the first pressure sensor 44, and the second pressure sensor 46 are input to the electronic control unit 60. Output signals of an atmospheric pressure sensor 52 for detecting the atmospheric pressure, an accelerator sensor 53 for detecting the depression amount of an accelerator pedal, a vehicle speed sensor 54 for detecting a vehicle speed, an ignition switch 55, and the like are also input to the electronic control unit 60. Hereinafter, the control that is executed by the electronic control unit 60 will be described as the respective functional parts of a drive unit 61, a pulsation detection unit 62, a front-side pressure calculation unit 64, a rear-side pressure calculation unit 65, a differential pressure determination unit 66, an abnormality determination unit 67, and an information unit 71. The electronic control unit 60 executes abnormality detection control that performs the detection of abnormality of the second purge passage 40.

The drive unit 61 executes opening and closing drive control to open and close the purge control valve 31 by controlling a duty ratio D of an energization signal to the purge control valve 31. That is, the drive unit 61 calculates the duty ratio D ($=\tau/T\times100$) as a ratio of an energization time $\tau$ to the purge control valve 31 with respect to a cycle T at a predetermined frequency such as 15 Hz, for example. Then, the energization control to the purge control valve 31 is executed based on the energization signal having the calculated duty ratio D. The duty ratio D is repeatedly calculated and set at predetermined intervals according to the operation state of the internal combustion engine 80, such as the concentration of the purge gas or the negative pressure in the intake passage, in the drive unit 61. When the duty ratio is set to 0%, the drive unit 61 does not perform energization and makes the purge control valve 31 be in a closed state. When the duty ratio is set to 100%, the drive unit 61 continues energization and makes the purge control valve 31 always be in a fully opened state. When the duty ratio is set to 50%, the drive unit 61 repeats energization and de-energization such that an energized state and a non-energized state are continued for the same time in the cycle T, to open and close the purge control valve 31. When the energization is executed, the purge control valve enters a fully opened state, and when the energization is stopped, the purge control valve enters a fully closed state.

When pulsation of the purge gas occurs in the first branch passage 41 and the second branch passage 42 due to the opening and closing drive of the purge control valve 31 by the drive unit 61, the pressure in each of the branch passages 41, 42 fluctuates. The pulsation detection unit 62 detects the pulsation of the purge gas flowing through each of the first branch passage 41 and the second branch passage 42, based on the output signals from the first pressure sensor 44 and the second pressure sensor 46 when the drive unit 61 drives the purge control valve 31 so as to open and close the purge control valve 31. The pulsation detection unit 62 has a bandpass filter 63 that passes solely an output signal having a frequency range (for example, a range of 12 to 18 Hz) corresponding to the frequency (for example, 15 Hz) of the opening and closing drive signal of the purge control valve 31 in the drive unit 61, among the output signals from the respective pressure sensors 44, 46. The bandpass filter 63 is a digital filter configured such that a pass frequency range of a signal can be made variable in accordance with the frequency of the opening and closing drive signal in the drive unit 61.

The front-side pressure calculation unit 64 calculates the front-side pressure that is the pressure further on the canister 20 side than the purge control valve 31 in the first purge passage 30, based on the output signal from the atmospheric pressure sensor 52, and the rear-side pressure calculation unit 65 calculates the rear-side pressure that is the pressure further on the second purge passage 40 side than the purge control valve 31 in the first purge passage 30, based on the output signal from the negative pressure sensor 50. The differential pressure determination unit 66 determines whether or not a front-rear differential pressure $\Delta P$ that is obtained by subtracting the rear-side pressure calculated by the rear-side pressure calculation unit 65 from the front-side pressure calculated by the front-side pressure calculation unit 64, is equal to or higher than a predetermined pressure Pt.

The abnormality determination unit 67 determines the abnormality of each of the branch passages 41, 42, based on the pulsation of the purge gas of each of the first branch passage 41 and the second branch passage 42 detected by the pulsation detection unit 62. That is, the abnormality determination unit 67 determines that the second purge passage 40 is abnormal, when the amplitude of the pulsation of the purge gas in each of the branch passage 41, 42 detected by the pulsation detection unit 62 is equal to or less than a determination value. The abnormality determination unit 67 has an amplitude calculation unit 68, a determination value calculation unit 69, and a provisional determination execution unit 70. The amplitude calculation unit 68 calculates the amplitude of the pulsation of the purge gas in each of the first branch passage 41 and the second branch passage 42 detected by the pulsation detection unit 62. The determination value calculation unit 69 calculates the determination value when the abnormality determination is performed. The provisional determination execution unit 70 performs a provisional determination of abnormality occurrence by comparing the amplitude of the pulsation of the purge gas in each of the branch passages 41, 42 calculated by the amplitude calculation unit 68 with the determination value calculated by the determination value calculation unit 69.

The information unit 71 informs the driver of the occurrence of abnormality of the second purge passage by turning on the information lamp 51 when the abnormality determination unit 67 determines that abnormality has occurred in at least one of the first branch passage 41 and the second branch passage 42.

The flow of a series of processing relating to the abnormality detection control that is executed by the electronic control unit 60 will be described with reference to the flowchart of FIGS. 2A and 2B. The abnormality detection control is repeatedly executed at predetermined intervals.

Figure 2A:
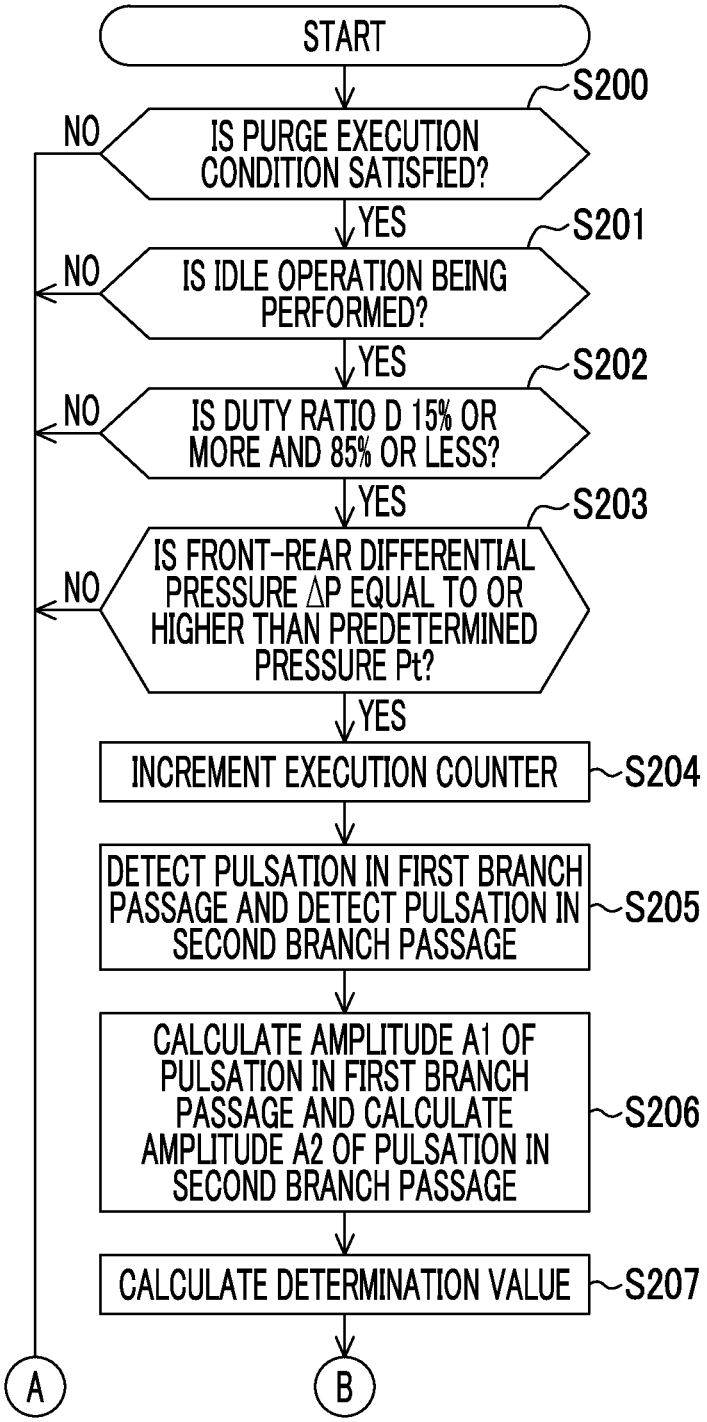
FIG. 2A is a flowchart showing a flow of a series of processing relating to abnormality detection control.

As shown in FIG. 2A, when a series of processing relating to the abnormality detection control is executed, the electronic control unit 60 first determines whether or not the purge execution condition is satisfied (step S200). In the processing of step S200, in a case where warm-up of the internal combustion engine 80 is completed, a determination that the purge execution condition is satisfied is made. In a case where a determination that the purge execution condition is satisfied is made (step S200: YES), next, whether or not the operation state of the internal combustion engine 80 is in an idle operation is determined (step S201). In the processing of step S201, for example, when both the depression amount of the accelerator pedal and the vehicle speed are zero and the ignition switch 55 is ON, a determination that the internal combustion engine 80 is in an idle operation is made.

In the processing of step S201, in a case where a determination that the internal combustion engine 80 is in an idle operation is made (step S201: YES), whether or not the duty ratio D of the energization signal to the purge control valve 31 set in the drive unit 61 is within a predetermined range is determined (step S202). In this embodiment, as the predetermined range, a range of 15% to 85% is set. Then, in a case where a determination that the duty ratio D is within a predetermined range is made (step S202: YES), the electronic control unit 60 calculates the front-side pressure and the rear-side pressure by the front-side pressure calculation unit 64 and the rear-side pressure calculation unit 65 and determines whether or not the front-rear differential pressure ΔP obtained by subtracting the rear-side pressure from the front-side pressure is equal to or higher than the predetermined pressure Pt, by the differential pressure determination unit 66 (step S203). The predetermined pressure Pt is set to the lowest differential pressure (for example, 40 kPa) among the differential pressures at which sufficient pulsation occurs in the second purge passage when the purge control valve 31 is driven to be opened and closed.

In the processing of step S203, in a case where a determination that the front-rear differential pressure ΔP is equal to or higher than the predetermined pressure Pt is made (step S203: YES), the processing proceeds to the processing of step S204 and the abnormality detection control is started. The electronic control unit 60 increments an execution counter in the processing of step S204 and counts the number of times of execution of the abnormality detection control. In the abnormality detection control, first, the pulsation of the purge gas in each of the first branch passage 41 and the second branch passage 42 associated with the opening and closing drive of the purge control valve 31 by the drive unit 61 is detected by the pulsation detection unit 62 (step S205). In the processing of step S205, first, the output signals of the first pressure sensor 44 and the second pressure sensor 46 are input to the pulsation detection unit 62.

Figure 3:
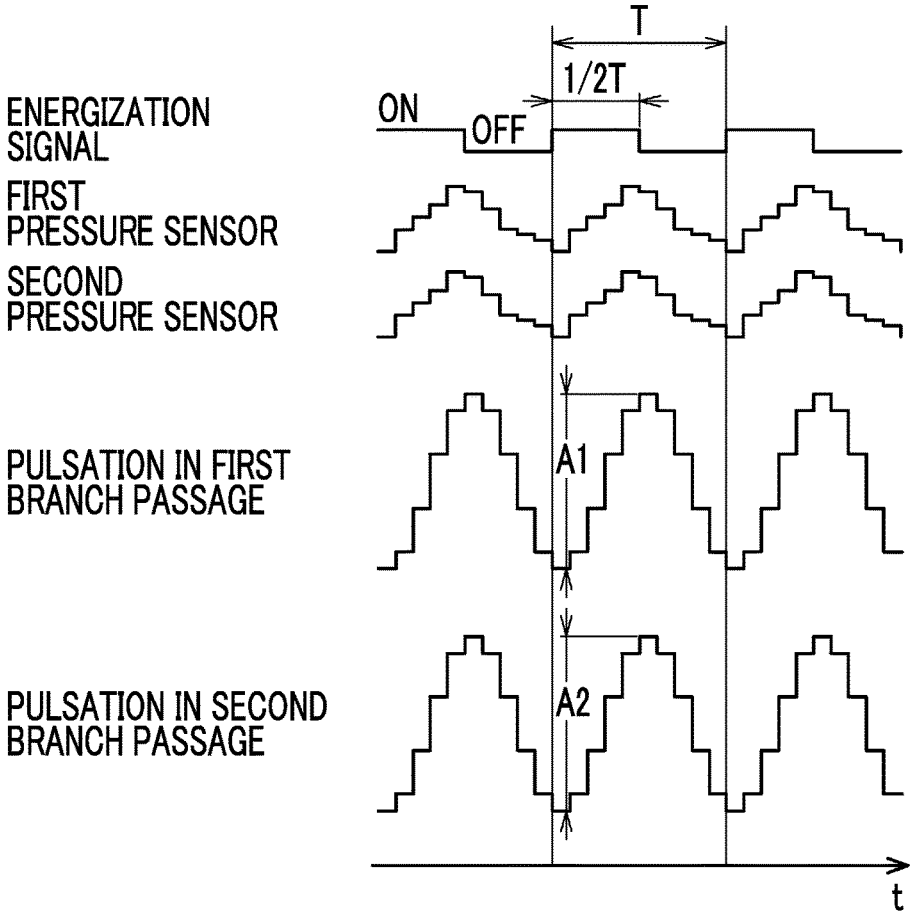
FIG. 3 is a timing chart schematically showing pulsation of a purge gas in a first branch passage and a second branch passage when a purge control valve is driven to be opened and closed.

As shown in the time chart of FIG. 3, in this embodiment, energization is executed to the purge control valve 31 at a time (=½T) of half the cycle T, for example ("energization signal" in FIG. 3). That is, the drive unit 61 is set so as to execute the energization control to the purge control valve 31 with the duty ratio D of 50%. With the energization control, the pulsation due to the flow of the purge gas occurs in the first branch passage 41 and the second branch passage 42. The pressure fluctuation due to the pulsation is detected by the first pressure sensor 44 and the second pressure sensor 46 ("first pressure sensor" and "second pressure sensor" in FIG. 3). The first pressure sensor 44 and the second pressure sensor 46 output voltage signals corresponding to the pressure at predetermined time intervals (for example, 4 ms). In the pulsation detection unit 62, when the output signals from the first pressure sensor 44 and the second pressure sensor 46 are introduced, solely the output signal having a frequency range corresponding to the frequency of the opening and closing drive signal of the purge control valve 31 in the drive unit 61, among the output signals from the pressure sensors 44, 46, is extracted by the bandpass filter 63. Then, the pulsation of the purge gas in each of the branch passages 41, 42 is detected ("pulsation in first branch passage" and "pulsation in second branch passage" in FIG. 3). The pulsation detection unit 62 amplifies the signal extracted by the bandpass filter 63 to increase the dynamic range of the signal.

Thereafter, the processing proceeds to the processing of step S206 in FIG. 2A and an amplitude A1 of the pulsation of the purge gas in the first branch passage 41 and an amplitude A2 of the pulsation of the purge gas in the second branch passage 42 detected by the pulsation detection unit 62 are calculated by the amplitude calculation unit 68 of the abnormality determination unit 67. In the processing of step S206, the amplitude calculation unit 68 calculates the difference between the minimum value and the maximum value per cycle of the pulsation of the purge gas in the first branch passage 41 as the amplitude A1 and calculates the difference between the minimum value and the maximum value per cycle of the pulsation of the purge gas in the second branch passage 42 as the amplitude A2, based on each pulsation detected by the pulsation detection unit 62, as shown in FIG. 3.

When the amplitudes A1, A2 are calculated in this manner, next, the processing proceeds to the processing of step S207 in FIG. 2A. In the processing of step S207, the determination value when the abnormality determination is performed is calculated by the determination value calculation unit 69. If abnormality occurs in the second purge passage 40, even if the purge control valve 31 is driven to be opened and closed, it is difficult for a change to occur in the flow of the purge gas in the second purge passage 40. For this reason, it becomes difficult for pulsation of the purge gas to occur in the second purge passage 40, and the amplitude of the pulsation becomes small. The determination value is determined in advance by experiment or the like so as to be smaller than the amplitude of the pulsation of the purge gas when the second purge passage 40 is in a normal state and larger than the amplitude of the pulsation of the purge gas when the second purge passage 40 is in an abnormal state, and is stored as a map in the electronic control unit 60.

Figure 4:
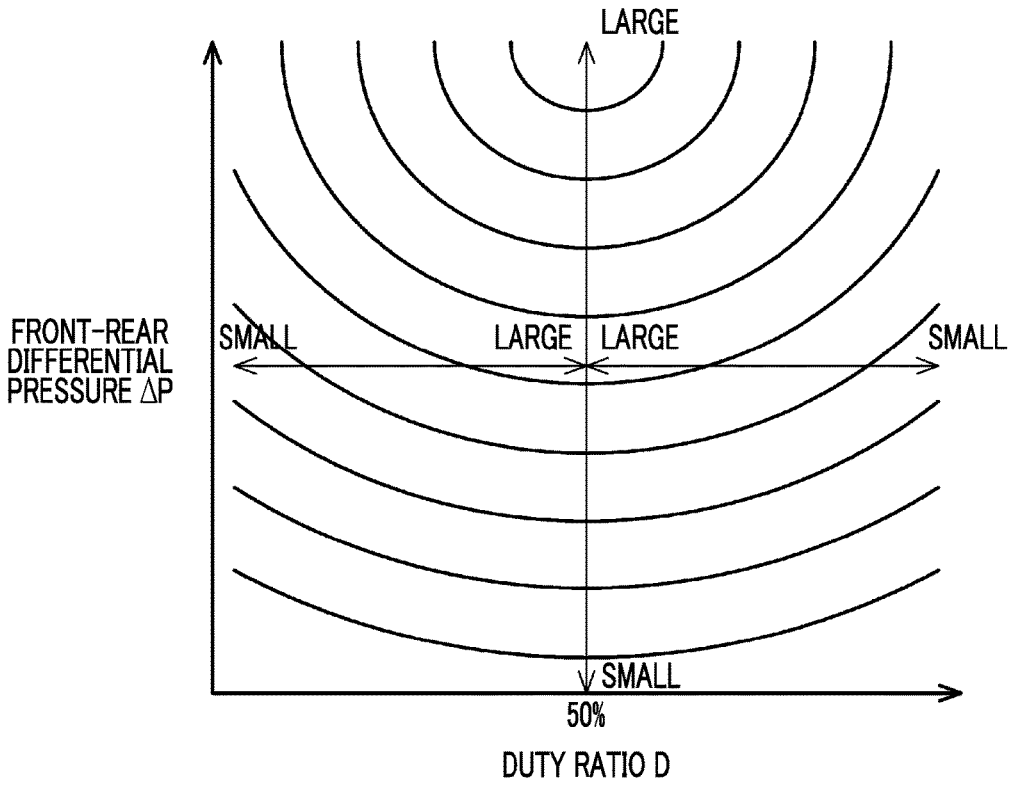
FIG. 4 is a map showing the relationship between a duty ratio, a differential pressure, and a determination value.

As shown in FIG. 4, the determination value is variably set according to the front-rear differential pressure ΔP in the purge control valve 31 and the duty ratio D of the energization signal to the purge control valve 31. The amplitudes A1, A2 of the pulsation of the purge gas in the second purge passage 40 associated with the opening and closing drive of the purge control valve 31 becomes larger as the front-rear differential pressure ΔP in the purge control valve 31 becomes larger. For this reason, the difference between the amplitude of the pulsation of the purge gas in the second purge passage 40 in a normal state and the amplitude of the pulsation of the purge gas in the second purge passage 40 in an abnormal state becomes larger as the front-rear differential pressure ΔP in the purge control valve 31 becomes larger. The amplitudes A1, A2 of the pulsation of the purge gas in the second purge passage 40 become the maximum when the duty ratio D is a predetermined ratio, and tend to become smaller as the duty ratio D deviates from the predetermined ratio. For this reason, the difference between the amplitude of the pulsation of the purge gas in the second purge passage 40 in a normal state and the amplitude of the pulsation of the purge gas in the second purge passage 40 in an abnormal state is the maximum when the duty ratio D is the predetermined ratio, and becomes smaller as the duty ratio D deviates from the predetermined ratio. In this embodiment, as the predetermined ratio, 50% is set.

Therefore, as shown in FIG. 4, in this embodiment, the determination value is set so as to be larger as the front-rear differential pressure ΔP becomes larger, and is set so as to become the largest value when the duty ratio D is 50% and become a small value as the duty ratio D deviates from 50%.

Figure 2B:
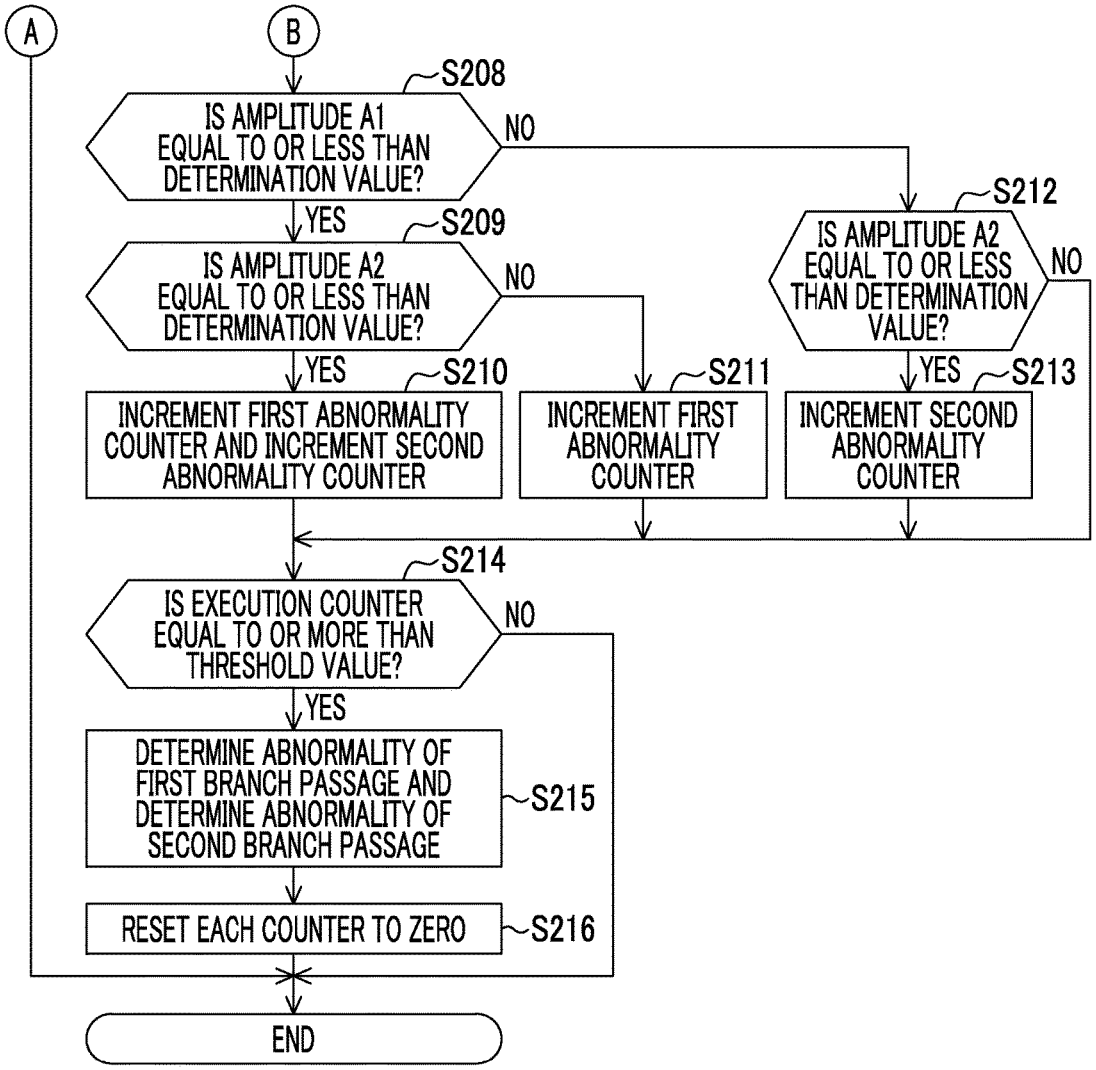
FIG. 2B is a flowchart showing a flow of a series of processing relating to abnormality detection control.

When the determination value is set in the processing of step S207 in this manner, the processing proceeds to the processing of step S208 in FIG. 2B and the provisional determination execution unit 70 determines whether or not the amplitude A1 of the pulsation of the purge gas in the first branch passage 41 is equal to or less than the determination value. In the processing of step S208, in a case where a determination that the amplitude A1 of the pulsation of the purge gas in the first branch passage 41 is equal to or less than the determination value is made (step S208: YES), next, whether or not the amplitude A2 of the pulsation of the purge gas in the second branch passage 42 is equal to or less than the determination value is determined (step S209). In the processing of step S209, in a case where a determination that the amplitude A2 of the pulsation of the purge gas in the second branch passage 42 is equal to or less than the determination value is made (step S209: YES), a determination that both the amplitude A1 of the pulsation of the purge gas in the first branch passage 41 and the amplitude A2 of the pulsation of the purge gas in the second branch passage 42 are equal to or less than the determination value can be made. For this reason, the processing proceeds to the processing of step S210 and the abnormality determination unit 67 increments a first abnormality counter and increments a second abnormality counter. The first abnormality counter is a counter indicating the number of times of a provisional determination that abnormality has occurred in the first branch passage 41, and the second abnormality counter is a counter indicating the number of times of a provisional determination that abnormality has occurred in the second branch passage 42.

Further, in the processing of step S209, in a case where a determination that the amplitude A2 of the pulsation of the purge gas in the second branch passage 42 exceeds the determination value is made (step S209: NO), a determination that solely the amplitude A1 of the pulsation of the purge gas in the first branch passage 41 is equal to or less than the judgment value can be made. For this reason, the processing proceeds to the processing of step S211 and the abnormality determination unit 67 increments solely the first abnormality counter.

In the processing of step S208, in a case where a determination that the amplitude A1 of the pulsation of the purge gas in the first branch passage 41 exceeds the determination value is made (step S208: NO), next, whether or not the amplitude A2 of the pulsation of the purge gas in the second branch passage 42 is equal to or less than the determination value is determined (step S212). In the processing of step S212, in a case where a determination that the amplitude A2 of the pulsation of the purge gas in the second branch passage 42 is equal to or less than the determination value is made (step S212: YES), a determination that solely the amplitude A2 of the pulsation of the purge gas in the second branch passage 42 is equal to or less than the judgment value can be made. For this reason, the processing proceeds to the processing of step S213 and the abnormality determination unit 67 increments solely the second abnormality counter.

On the other hand, in the processing of step S212, in a case where a determination that the amplitude A2 of the pulsation of the purge gas in the second branch passage 42 exceeds the determination value is made (step S212: NO), a determination that both the amplitude A1 of the pulsation of the purge gas in the first branch passage 41 and the amplitude A2 of the pulsation of the purge gas in the second branch passage 42 exceed the determination value can be made. For this reason, the processing proceeds to the next processing without incrementing both the first abnormality counter and the second abnormality counter.

If the provisional abnormality determination in each of the branch passages 41, 42 is executed by the processing of step S208 to step S213 in this manner, next, whether or not the execution counter is equal to or larger than a threshold value is determined (step S214). As the threshold value, for example, 100 is set. In a case where the execution counter reaches the threshold value (step S214: YES), next, the abnormality determination unit 67 performs a determination on abnormality of the first branch passage 41 and the second branch passage 42. In the processing of step S214, abnormality of the first branch passage 41 is determined according to whether or not a ratio R1 (=first abnormality counter/execution counter×100) of the number of times of a provisional determination that the first branch passage 41 is abnormal with respect to the number of times of execution of the abnormality detection control is equal to or more than the abnormality rate (for example, 80%). That is, if the ratio R1 is equal to or more than the abnormality rate, a determination that abnormality has occurred in the first branch passage 41 is made. Similarly, abnormality of the second branch passage 42 is determined according to whether or not a ratio R2 (=second abnormality counter/execution counter×100) of the number of times of a provisional determination that the second branch passage 42 is abnormal with respect to the number of times of execution of the abnormality detection control is equal to or more than the abnormality rate. That is, if the ratio R2 is equal to or more than the abnormality rate, a determination that abnormality has occurred in the second branch passage 42 is made. Then, in a case where a determination that abnormality has occurred in at least one of the first branch passage 41 and the second branch passage 42 is made, the information unit 71 turns on the information lamp 51. Thereafter, the processing proceeds to the processing of step S216, in which the execution counter, the first abnormality counter, and the second abnormality counter are then reset, and a series of processing relating to the abnormality detection control is ended.

In the processing of step S214, in a case where the execution counter has not reached the threshold value (step S214: NO), the series of processing relating to the abnormality detection control is ended without executing the subsequent processing. In this way, the first abnormality counter and the second abnormality counter are maintained until the execution counter reaches the threshold value, and the number of times of a provisional determination that abnormality has occurred in each of the branch passages 41, 42 is counted each time the abnormality detection control is executed.

Further, in a case where a determination that the purge execution condition is not satisfied is made (step S200: NO) and a case where a determination that the idle operation is not being performed is made (step S201: NO), the electronic control unit 60 ends a series of processing relating to the abnormality detection control without executing the subsequent processing. Also in a case where a determination that the duty ratio D of the energization signal to the purge control valve 31 set in the drive unit 61 is outside the predetermined range is made (step S202: NO) and a case where a determination that the front-rear differential pressure ΔP is less than the predetermined pressure Pt is made (step S203: NO), the electronic control unit 60 ends a series of processing relating to the abnormality detection control without executing the subsequent processing.

Next, an abnormality determination aspect by the abnormality detection control will be described with reference to the timing chart of FIG. 5. In the following, a case where the first branch passage 41 is normal and abnormality occurs in the second branch passage 42 will be described as an example.

Figure 5:
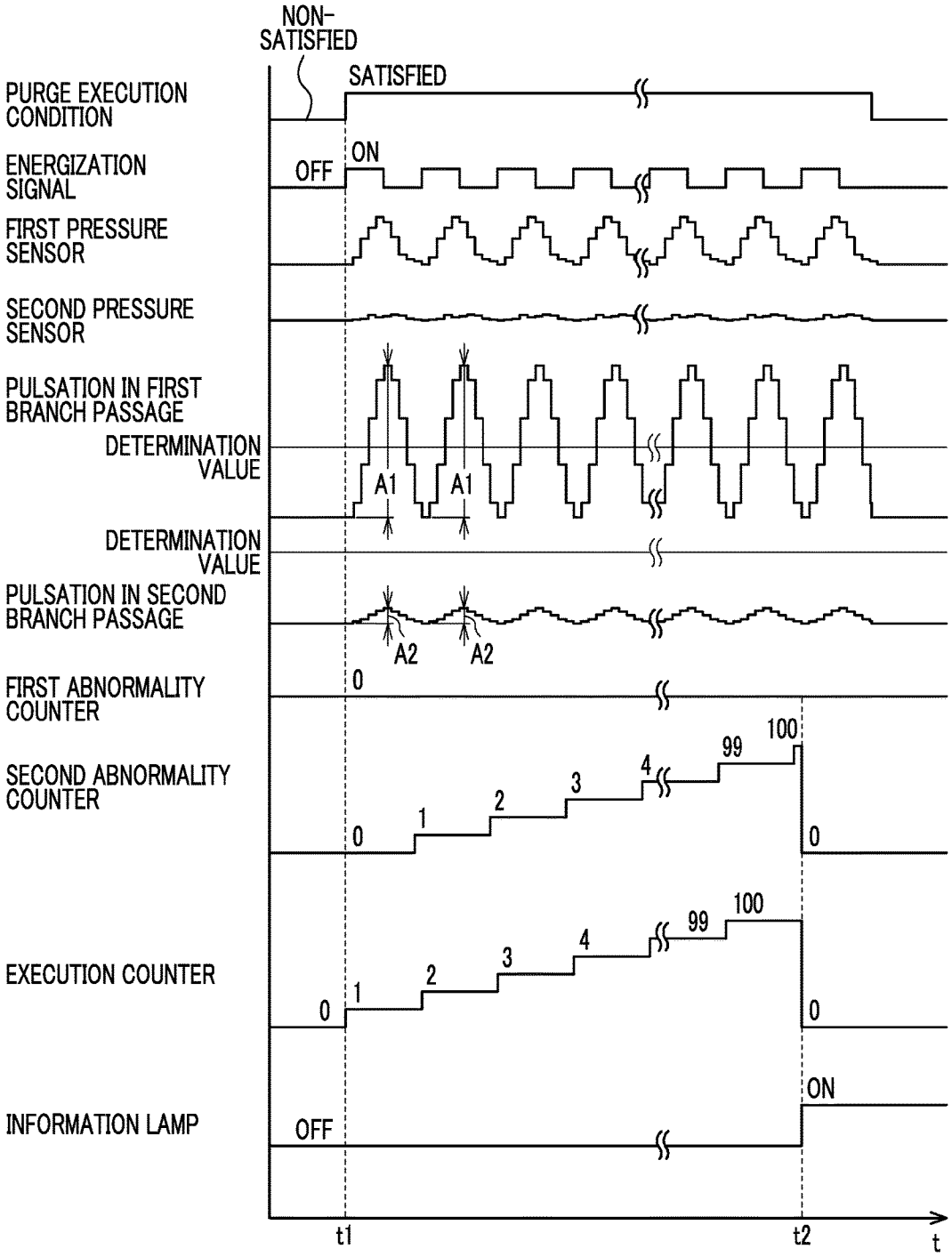
FIG. 5 is a timing chart showing an abnormality determination aspect in the abnormality detection control.

At timing t1 when the purge execution condition is satisfied, as shown in "purge execution condition" in FIG. 5, the drive unit 61 starts energization control to the purge control valve 31 with the set duty ratio D and performs the opening and closing drive of the purge control valve 31, as shown in "energization signal" in FIG. 5.

When the purge control valve 31 is driven to be opened, the purge gas flows from the canister 20 to the intake passage through the first purge passage 30 and the second purge passage 40. When the purge control valve 31 is driven to be closed, the flow of the purge gas through the first purge passage 30 and the second purge passage 40 is stopped. For this reason, in the first branch passage 41 in which abnormality does not occur, pulsation of the purge gas occurs due to the flow of the purge gas associated with the opening and closing drive of the purge control valve 31. That is, in the first pressure sensor 44 provided in the first branch passage 41, when the purge control valve 31 is driven to be opened, the pressure that is detected increases due to the flow of the purge gas, and when the purge control valve 31 is driven to be closed, the pressure that is detected decreases due to the introduction of the negative pressure from the intake passage. As a result, as shown in "first pressure sensor" in FIG. 5, the output signal of the first pressure sensor 44 periodically fluctuates.

On the other hand, in the second branch passage 42 in which abnormality has occurred, even if the purge control valve 31 is driven to be opened and closed, it is difficult for a change to occur in the flow of the purge gas. For this reason, it is difficult for pulsation of the purge gas to occur in the second purge passage 40, and fluctuation of the output signal of the second pressure sensor 46 is small, as shown in "second pressure sensor" in FIG. 5. Not only the influence of the pulsation of the purge gas but also the influence or the like of noise or disturbance of the pressure sensors 44, 46 is reflected in the output signals of the first pressure sensor 44 and the second pressure sensor 46.

As described above, in a case where all the conditions that the purge execution condition is satisfied, the idle operation is being performed, the duty ratio D is within the predetermined range, and the front-rear differential pressure ΔP is equal to or higher than the predetermined pressure Pt are satisfied, the electronic control unit 60 starts the abnormality detection control. In the example described above, at timing t1 when the purge execution condition is satisfied, all the above conditions are satisfied and the abnormality detection control is started.

When the abnormality detection control is started, the execution counter is incremented, as shown in "execution counter" in FIG. 5. Then, as shown in "pulsation in first branch passage" in FIG. 5, the pulsation of the purge gas in the first branch passage 41 is detected from the output signal of the first pressure sensor 44 by the pulsation detection unit 62. As shown in "pulsation in second branch passage" in FIG. 5, the pulsation of the purge gas in the second branch passage 42 is detected from the output signal of the second pressure sensor 46 by the pulsation detection unit 62. The pulsation detected in this way is pulsation that is processed by the bandpass filter 63 and reflects solely the output signal corresponding to the frequency of the opening and closing drive signal of the purge control valve 31, among the output signals from the pressure sensors 44, 46. Since there is no abnormality in the first branch passage 41, the amplitude A1 of the pulsation detected by the pulsation detection unit 62 exceeds the determination value. On the other hand, since abnormality has occurred in the second branch passage 42, the amplitude A2 of the pulsation detected by the pulsation detection unit 62 is equal to or less than the determination value. For this reason, the first abnormality counter is not incremented, as shown in "first abnormality counter" in FIG. 5, and the second abnormality counter is incremented, as shown in "second abnormality counter" in FIG. 5. Then, the abnormality detection control is ended.

Thereafter, the abnormality detection control is executed at predetermined intervals, whereby the second abnormality counter increases. Then, the abnormality determination is performed in the abnormality detection control when the execution counter reaches 100 that is a threshold value. In this way, as shown in "information lamp" in FIG. 5, at timing t2, the information lamp 51 is turned on, and each counter is reset.

The operational effects of this embodiment will be described. (1) In this embodiment, the pulsation of the purge gas in the second purge passage 40 when the purge control valve 31 is driven to be opened and closed is detected. For this reason, it is possible to detect the occurrence of abnormality in the second purge passage 40 of the evaporated fuel treating device, based on the pulsation of the purge gas in the second purge passage 40 when the purge control valve 31 is driven to be opened and closed.

(2) The first check valve 43 is provided in the first branch passage 41 and the second check valve 45 is provided in the second branch passage 42. For this reason, even in a case where the second purge passage 40 is configured of a plurality of branch passages that includes the first branch passage 41 and the second branch passage 42, it is possible to restrain the intake air flowing in from the intake passage from flowing between the branch passages 41, 42.

In a case where the second purge passage 40 is configured of the branch passages 41, 42, when at least one of the branch passages 41, 42 of the second purge passage 40 is normal, pulsation of the purge gas occurs in the first purge passage 30 or the canister 20. For this reason, even if a pressure sensor is disposed in the first purge passage 30 or the canister 20, it is difficult to detect abnormality of the second purge passage 40. In this embodiment, the first pressure sensor 44 is provided further on the intake passage side than the first check valve 43 in the first branch passage 41 of the second purge passage 40, and the second pressure sensor 46 is provided further on the intake passage side than the second check valve 45 in the second branch passage 42. For this reason, in a case where the second purge passage 40 is configured of the branch passages 41, 42, it also becomes possible to individually detect occurrence of abnormality of each of the branch passages 41, 42.

(3) Since the pulsation detection unit 62 has the bandpass filter 63, it is possible to extract solely the output signal having a frequency range corresponding to the frequency of the opening and closing drive signal of the purge control valve 31, among the output signals from the first pressure sensor 44 and the second pressure sensor 46. For this reason, it is possible to eliminate the influence or the like of noise or disturbance of the pressure sensors 44, 46, which is not related to the frequency of the drive signal, and thus it becomes possible to detect the pulsation of the purge gas reflecting solely the influence of the opening and closing drive of the purge control valve 31. Therefore, when the occurrence of abnormality in the second purge passage 40 is detected based on the pulsation of the purge gas, it is possible to improve the accuracy of detection of abnormality occurrence.

(4) The electronic control unit 60 starts the abnormality detection control when the front-rear differential pressure ΔP in the purge control valve 31 is equal to or higher than the predetermined pressure Pt. For this reason, the flow of the purge gas easily changes due to the opening and closing drive of the purge control valve 31, and thus it is possible to perform abnormality detection when the pulsation of the purge gas is easy to occur in the second purge passage 40. Therefore, the detection of the pulsation of the purge gas in the pulsation detection unit 62 becomes easy.

(5) For example, when the duty ratio D is extremely low or extremely high, even if the purge control valve 31 is driven to be opened and closed, the difference between the opening time and the closing time of the purge control valve 31 becomes larger than usual, and thus the pulsation of the purge gas is difficult to occur in the second purge passage 40. In the above configuration, whether to execute the abnormality detection control is determined according to the duty ratio D. That is, when the duty ratio D is not within a predetermined range, the abnormality detection control is not executed, and therefore, it is possible to perform abnormality detection in a situation where the pulsation of the purge gas is easy to occur in the second purge passage 40, excluding a case where the duty ratio D is extremely low or extremely high. Therefore, the detection of the pulsation of the purge gas in the pulsation detection unit 62 becomes easy. Even in a case where the control in which the duty ratio D becomes 100% is continuously executed for several cycles and thereafter, the control in which the duty ratio D becomes 0% is continuously executed for several cycles, the pulsation of the purge gas in each of the branch passages 41, 42 can occur by repeating such control. However, in this case, the cycle of the pulsation of the purge gas tends to become longer. In this embodiment, the abnormality detection control is executed with the duty ratio D within a range of 15% to 85%, and therefore, as described above, the cycle of the pulsation of the purge gas becomes shorter compared to a case of detecting the pulsation of the purge gas for several cycles, and thus it is possible to increase the execution frequency of the abnormality determination. Therefore, it is also possible to shorten the time related to abnormality detection.

(6) The determination value of the amplitudes A1, A2 related to the abnormality determination is set to be larger as the front-rear differential pressure ΔP in the purge control valve 31 becomes larger. That is, the determination value is set to a larger value as the front-rear differential pressure ΔP is larger and the amplitudes A1, A2 of the pulsation of the purge gas is easier to become large. In this way, the difference between the amplitude of the pulsation of the purge gas when abnormality occurs in the second purge passage 40 and the determination value is set to be larger as the front-rear differential pressure ΔP becomes larger, and thus it is possible to suppress erroneous determination at the time of abnormality determination. Therefore, it is possible to enhance the abnormality detection accuracy.

(7) The determination value of the amplitudes A1, A2 related to the abnormality determination become a largest value when the duty ratio D is 50%, and becomes a smaller value as the duty ratio D deviates from 50%. For this reason, the duty ratio D is set to a value close to 50%, and thus the determination value is set to a larger value as the amplitudes A1, A2 of the pulsation of the purge gas is easier to become large. In this way, the difference between the amplitude of the pulsation of the purge gas when abnormality occurs in the second purge passage 40 and the determination value is set to be larger as the amplitude of the pulsation of the purge gas is easier to become large, whereby it is possible to suppress erroneous determination at the time of abnormality determination. Therefore, it is possible to enhance the abnormality detection accuracy.

(8) The electronic control unit 60 starts the abnormality detection control during the idle operation in which the negative pressure in the intake passage increases. For this reason, it is possible to perform the abnormality detection control when the front-rear differential pressure ΔP in the purge control valve 31 is large. That is, the abnormality detection control can be executed when the flow of the purge gas is easy to change due to the opening and closing drive of the purge control valve 31, and thus it is possible to support the accuracy of the abnormality detection of the second purge passage 40.

(9) In this embodiment, the abnormality determination unit 67 determines the abnormality of the second purge passage 40 according to whether or not the ratios R1, R2 of the number of times of a provisional determination that each of the branch passages 41, 42 is abnormal with respect to the number of times of execution of the abnormality detection control are equal to or more than the abnormality rate. As described above, by determining the abnormality of the second purge passage 40, based on the ratio of the provisional determination that abnormality has occurred, it is possible to support the accuracy of the abnormality determination even if a situation occurs in which it can be provisionally determined that abnormality has temporarily occurred due to some factor regardless of being normal.

The above-described embodiment can be implemented to be modified as described below. The following modification examples can also be implemented to be appropriately combined with each other. The electronic control unit 60 is made so as to start the abnormality detection control when the operation state of the internal combustion engine is in an idle operation. However, the electronic control unit 60 may be made so as to execute the abnormality detection control regardless of whether or not the operation state of the internal combustion engine is in an idle operation. In this case, the processing of step S201 can be omitted in the flowchart of FIG. 2A.

In the above-described embodiment, the abnormality determination unit 67 is made so as to inform the driver of the abnormality by turning on the information lamp 51 in a case where a determination that abnormality has occurred in either of the first branch passage 41 or the second branch passage 42 is made. However, information means may be changed as appropriate. For example, a configuration may be made in which an information lamp corresponding to the first branch passage 41 and an information lamp corresponding to the second branch passage 42 are disposed and the respective information lamps are turned on corresponding to the abnormality of the first branch passage 41 and the second branch passage 42. It is also possible to omit the information lamp. In this case, for example, a configuration may be made such that, in a case where the abnormality determination unit 67 determines abnormality, the abnormality determination is recorded, and when maintenance or the like is performed, a worker accesses the abnormality determination unit 67 so as to be able to detect the occurrence of abnormality.

The method of determining the abnormality of the second purge passage in the abnormality determination unit 67 is not limited to the method based on the result of a plurality of times of provisional determinations as described above. For example, it is also possible to determine that the first branch passage 41 is abnormal, in a case where the amplitude A1 of the pulsation of the purge gas in the first branch passage 41 is equal to or less than the determination value, and to determine that the second branch passage 42 is abnormal, in a case where the amplitude A2 of the pulsation of the purge gas in the second branch passage 42 is equal to or less than the determination value. That is, although it is also possible to perform the abnormality determination by considering the comparison result of each of the amplitudes A1, A2 and the determination value by a plurality of times, as in the above-described embodiment, it is also possible to perform abnormality determination, based on a single comparison result of each of the amplitudes A1, A2 and the determination value. In this case, as compared with the above-described embodiment, it is also possible to shorten a time to completion of the abnormality determination.

The abnormality determination unit 67 determines abnormality, based on the pulsation of the purge gas in the second purge passage 40, and it is also possible to determine abnormality, based on parameters other than the amplitudes A1, A2 of the pulsation of the purge gas. For example, the abnormality of the second purge passage 40 may be determined by comparing the average value of the amplitude in the pulsation of the purge gas with the determination value, or the abnormality of the second purge passage 40 may be determined by comparing the locus length of the pulsation of the purge gas with the determination value. The locus length of the pulsation of the purge gas can be calculated as follows, for example.

Figure 6:
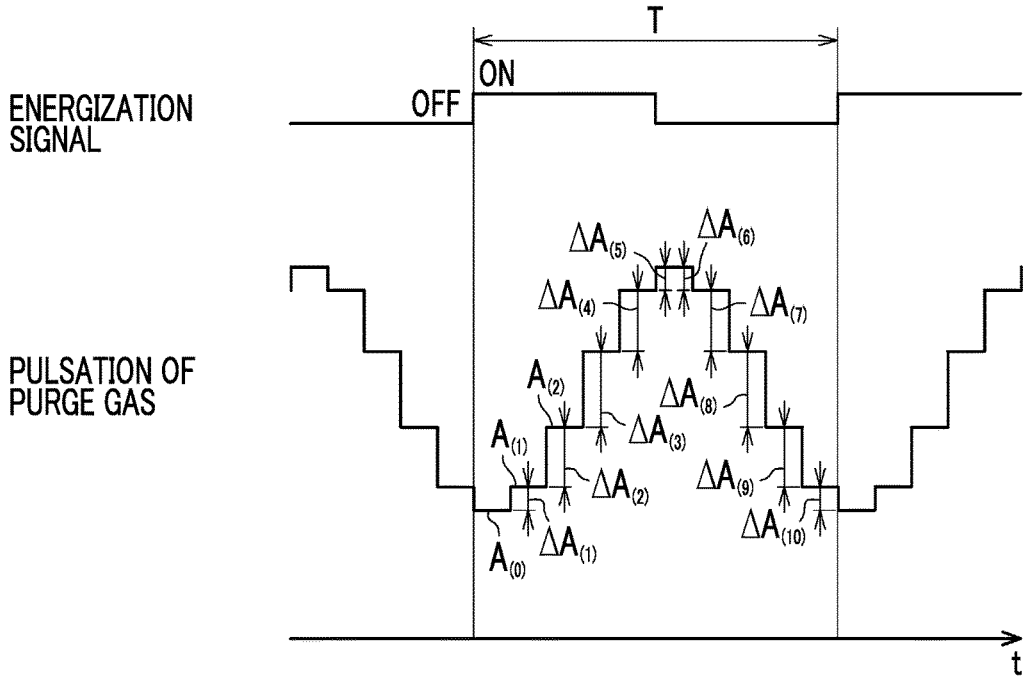
FIG. 6 is a timing chart schematically showing a calculation aspect of a locus length in the pulsation of the purge gas.

As shown in "energization signal" and "pulsation of purge gas" in FIG. 6, the pulsation of the purge gas per cycle T in the second purge passage 40 is detected in the pulsation detection unit 62. As described above, each of the pressure sensors 44, 46 outputs a voltage signal corresponding to pressure at predetermined time intervals. For this reason, as shown in "pulsation of purge gas" in FIG. 6, in the pulsation, an absolute value $\Delta A_{(n)}$ (>0) of the difference between a previous value $A_{(n-1)}$ and a current value $A_{(n)}$ of the value corresponding to the signal obtained from the pressure sensor is calculated and a locus length $\Sigma A$ ($=\Delta A_{(1)}+\Delta A_{(2)}+\ldots+\Delta A_{(10)}$) is calculated by integrating the calculated absolute value by one cycle. The locus length $\Sigma A$ also correlates with the pulsation of the purge gas, and the larger the pulsation becomes, the larger the locus length $\Sigma A$ also becomes. Similarly, the larger the pulsation becomes, the larger the average value of the amplitude in the pulsation of the purge gas becomes. Therefore, even in a case where the abnormality of the second purge passage 40 is determined by comparing the average value of the amplitude in the pulsation of the purge gas or the locus length $\Sigma A$ with the determination value in this way, similar to the above-described embodiment, it is also possible to variably set the determination value according to the front-rear differential pressure $\Delta P$ or the duty ratio D.

An aspect of calculating the determination value in the determination value calculation unit 69 is not limited to the aspect described above. For example, in a case where the determination value become a largest value when the duty ratio D is a predetermined ratio, and becomes a smaller value as the duty ratio D deviates from the predetermined ratio, the predetermined ratio is not limited to 50% as long as it is a situation where the amplitudes A1, A2 of the pulsation of the purge gas is easy to become large, and it is also possible to set the predetermined ratio to 45%, 55%, or the like, for example. In the above-described embodiment, the determination value may be variably set according to solely the front-rear differential pressure $\Delta P$ in the purge control valve 31 without being variably set according to the duty ratio D, or the determination value may be variably set according to solely the duty ratio D without being variably set according to the front-rear differential pressure $\Delta P$ in the purge control valve 31. Further, it is also possible to set the determination value as a fixed value. Even in these cases, it is favorable if the determination value is set so as to be smaller than the amplitude of the pulsation of the purge gas when the second purge passage 40 is normal, and larger than the amplitude of the pulsation of the purge gas when the second purge passage 40 is abnormal. The setting of the determination value as described above is based on a value obtained through, for example, an experiment or the like.

In the flowchart of FIG. 2A, in a case where a determination that the duty ratio D in the drive unit 61 is within a predetermined range is made (step S202: YES) and a determination that the front-rear differential pressure $\Delta P$ in the purge control valve 31 is equal to or higher than the predetermined pressure Pt is made (step S203: YES), the processing proceeds to the processing of step S204 and the abnormality detection control is started. Instead of such a configuration, a configuration may be made such that, in a case where a determination that either of the processing of step S202 or the processing of step S203 is affirmative is made, the processing proceeds to the processing of step S204 and the abnormality detection control is started.

The electronic control unit 60 determines whether to execute the abnormality detection control, according to the duty ratio D in the drive unit 61. That is, the abnormality detection control is executed when the duty ratio D is within a predetermined range of 15% to 85%. In such a configuration, as long as it is a situation where the amplitudes A1, A2 of the pulsation of the purge gas are easy to become large, it is also possible to set, for example, a range of 5% to 95% as the predetermined range. Further, whether to execute the abnormality detection control may be determined, for example, by comparison of the duty ratio D with the predetermined ratio set in advance, instead of setting the predetermined range. Further, it is also possible to execute the abnormality detection control regardless of the duty ratio D. In this case, the processing of step S202 can be omitted in the flowchart of FIG. 2A.

The electronic control unit 60 is made so as to start the abnormality detection control when the front-rear differential pressure ΔP in the purge control valve 31 is equal to or higher than the predetermined pressure Pt. However, the electronic control unit 60 may be made so as to execute the abnormality detection control regardless of whether or not the front-rear differential pressure ΔP is equal to or higher than the predetermined pressure Pt. In this case, the processing of step S203 can be omitted in the flowchart of FIG. 2A.

In the drive unit 61, it is also possible to calculate the frequency of the opening and closing drive signal to the purge control valve 31 according to the operation state of the internal combustion engine 80, such as the concentration of the purge gas or the negative pressure in the intake passage, and to variably set the frequency. The higher the frequency of the opening and closing drive signal, the higher the vibration frequency of the pulsation of the purge gas in the second purge passage 40 associated with the opening and closing drive of the purge control valve 31 becomes. For this reason, even in such a case, the detection accuracy of the pulsation of the purge gas is enhanced by setting a pass frequency range of the bandpass filter 63 in the pulsation detection unit 62 to be variable in accordance with the frequency of the opening and closing drive signal in the drive unit 61.

It is also possible to omit the bandpass filter 63 in the pulsation detection unit 62. In the second purge passage 40, the first pressure sensor 44 is provided in the first branch passage 41, the second pressure sensor 46 is provided in the second branch passage 42, and abnormality in each of the branch passages 41, 42 is detected. However, it is also possible to omit one of the pressure sensors. Even in such a configuration, occurrence of abnormality in the second purge passage 40 can be detected by detecting the occurrence of abnormality in at least one of the branch passages.

In the above-described embodiment, an example in which the second purge passage 40 is configured of two branch passages; the first branch passage 41 and the second branch passage 42, is shown. The number of branch passages configuring the second purge passage 40 is not limited to two and may be one, or three or more. In a case where the second purge passage 40 is configured of three or more branch passages, it is preferable to provide a check valve in each of the branch passages and provide a pressure sensor further on the intake passage side than the check valve.

As the evaporated fuel treating device, an example in which the evaporated fuel generated in the fuel tank is supplied to the combustion chambers of the V-type internal combustion engine has been described. However, the evaporated fuel treating device is not limited to such an example. For example, even in a case where the evaporated fuel generated in the fuel tank is supplied to combustion chambers of an in-line type internal combustion engine, it is possible to adopt the same configuration as that in the above-described embodiment. In the following, the same configurations as those in the above-described embodiment are denoted by the same reference numerals and description thereof is omitted.

Figure 7:
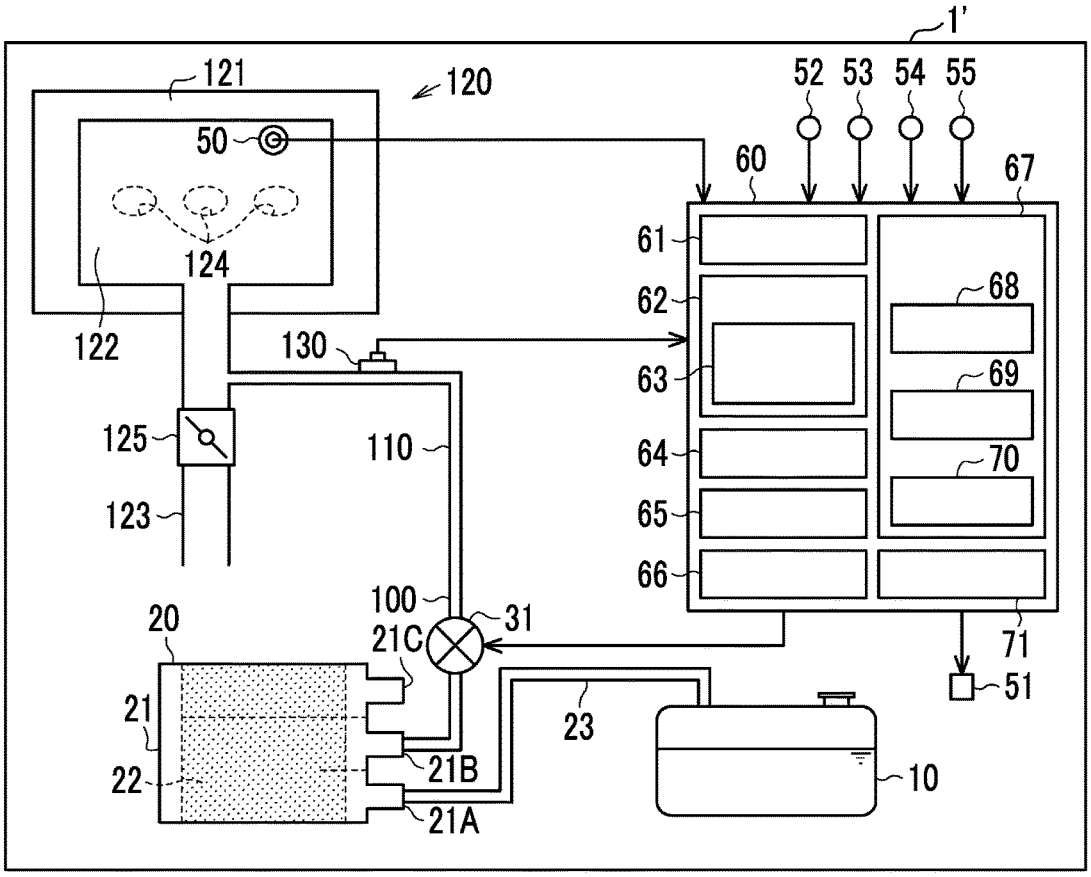
FIG. 7 is a schematic diagram showing a configuration of a modification example of the evaporated fuel treating device.

As shown in FIG. 7, an evaporated fuel treating device mounted on a vehicle 1' has a first purge passage 100 having a first end connected to the second opening portion 21B of the canister 20. The purge control valve 31 is provided on the pathway of the first purge passage 100. A second purge passage 110 is connected to a second end of the first purge passage 100. A second end of the second purge passage 110 is connected to an intake passage of an internal combustion engine 120.

Three combustion chambers (not shown) are provided side by side in a cylinder array direction (the right-left direction in FIG. 7) in an engine main body 121 of the internal combustion engine 120. The internal combustion engine 120 is also provided with a surge tank 122 that is one constituent member of the intake passage. An intake pipe 123 that is one constituent member of the intake passage is connected to the surge tank 122. Intake air is introduced into the surge tank 122 through the intake pipe 123. A throttle valve 125 is provided in the intake pipe 123. The amount of intake air flowing through the intake pipe 123 is adjusted by the throttle valve 125. A first end of each of a plurality of branch pipes 124 is connected to the surge tank 122. The branch pipes 124 respectively communicate with the combustion chambers provided in the engine main body 121. The intake air flowing from the intake pipe 123 to the surge tank 122 is supplied to each combustion chamber of the engine main body 121 through each of the branch pipes 124. The surge tank 122 is provided with the negative pressure sensor 50 for detecting the pressure in the surge tank 122.

The second end of the second purge passage 110 is connected further to the intake downstream side than the throttle valve 125 in the intake pipe 123. In this way, the second end of the first purge passage 100 communicates with the intake pipe 123. The second purge passage 110 is provided with a pressure sensor 130 as the pulsation detection sensor.

In the configuration shown in FIG. 7, when the drive unit 61 of the electronic control unit 60 opens the purge control valve 31, the purge gas flows from the canister 20 to the intake pipe 123 through the first purge passage 100 and the second purge passage 110. The purge gas flowing through the intake pipe 123 flows into the surge tank 122 together with the intake air and is supplied to each combustion chamber through each of the branch pipes 124. When the drive unit 61 of the electronic control unit 60 closes the purge control valve 31, the flow of the purge gas through the first purge passage 100 and the second purge passage 110 is stopped. For this reason, when abnormality such as clogging or disengagement does not occur in the second purge passage 110, pulsation of the purge gas occurs in the second purge passage 110 due to the flow of the purge gas associated with the opening and closing drive of the purge control valve 31. On the other hand, if abnormality occurs in the second purge passage 110, even if the purge control valve 31 is driven to be opened and closed, it is difficult for a change to occur in the flow of the purge gas in the second purge passage 110. Therefore, also in the configuration shown in FIG. 7, by detecting the pulsation of the purge gas in the second purge passage 110 by detecting the pulsation of the purge gas in the second purge passage 110 when the purge control valve 31 is driven to be opened and closed, by the pressure sensor 130, it is possible to detect the occurrence of abnormality in the second purge passage 110 in the evaporated fuel treating device.

Figure 8:
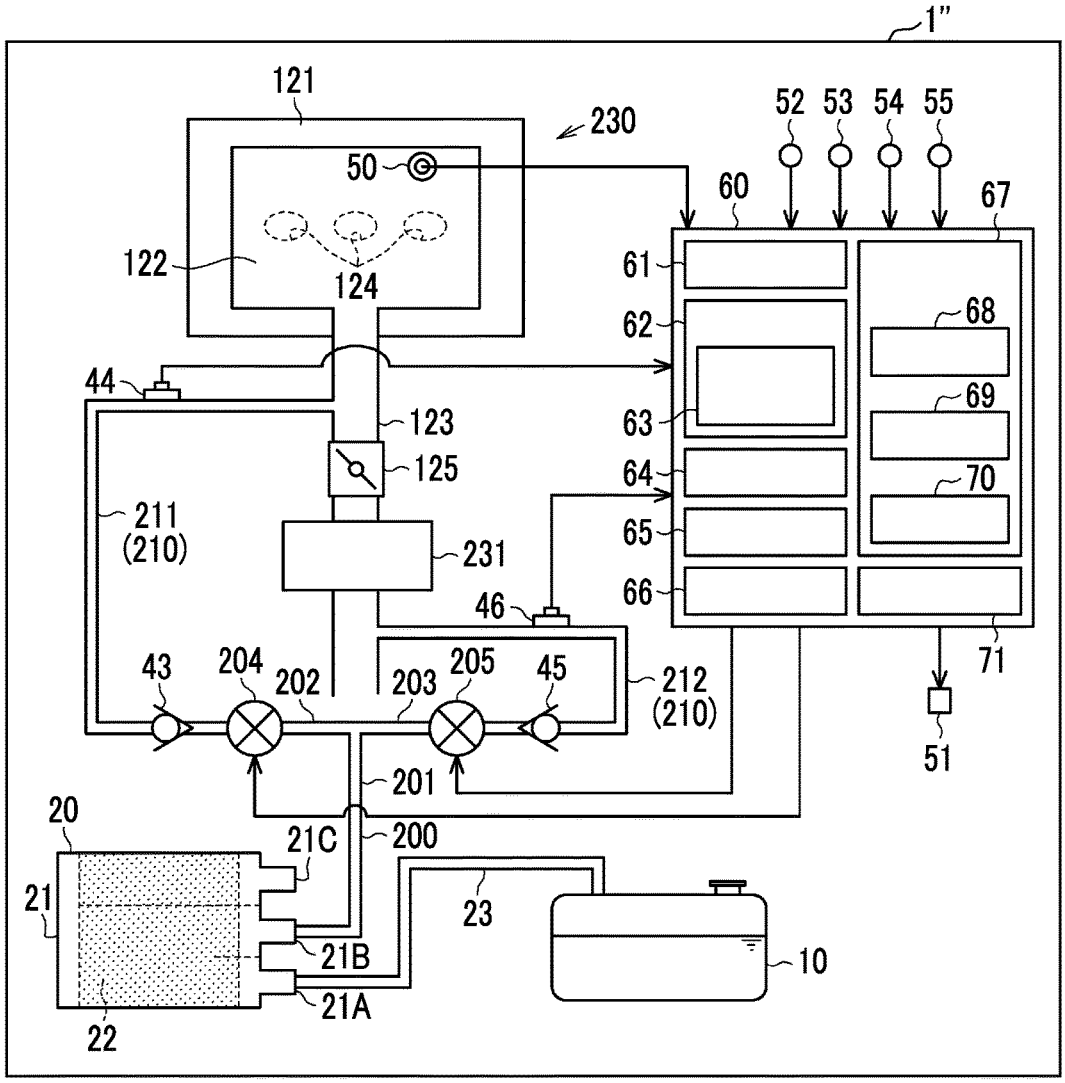
FIG. 8 is a schematic diagram showing a configuration of another modification example of the evaporated fuel treating device.

The evaporated fuel treating device can also adopt the configuration shown in FIG. 8. As shown in FIG. 8, an evaporated fuel treating device mounted on a vehicle 1" has a first purge passage 200 having a first end connected to the second opening portion 21B of the canister 20. The first purge passage 200 is branched at a second end portion thereof. That is, the first purge passage 200 is configured of a main pipe 201 on the canister 20 side, and a first branch pipe 202 and a second branch pipe 203 extending to branch from the main pipe 201. A first purge control valve 204 is provided on the pathway of the first branch pipe 202. A second purge control valve 205 is provided on the pathway of the second branch pipe 203. The first purge control valve 204 and the second purge control valve 205 are electromagnetic valves and are driven to be opened and closed according to the energized state of the electromagnetic valve.

A second purge passage 210 is connected to a second end of the first purge passage 200. The second purge passage 210 is configured of a first purge pipe 211 connected to the first branch pipe 202, and a second purge pipe 212 connected to the second branch pipe 203. Each of the purge pipes 211, 212 has a first end connected to a branched second end of the first purge passage 200, and a second end connected to an intake passage of an internal combustion engine 230.

The configuration of the internal combustion engine 230 is the same as that of the internal combustion engine 120 except that a compressor 231 of a supercharger is disposed on the pathway of the intake pipe 123. The compressor 231 is disposed further on the intake upstream side than the throttle valve 125 in the intake pipe 123.

The second end of the first purge pipe 211 in the second purge passage 210 is connected further to the intake downstream side than the throttle valve 125 in the intake pipe 123. In this way, the first branch pipe 202 of the first purge passage 200 communicates with the intake pipe 123. The first check valve 43 is provided on the pathway of the first purge pipe 211. In the first purge pipe 211, the first pressure sensor 44 as the pulsation detection sensor is provided further on the intake pipe 123 side than the first check valve 43.

The second end of the second purge pipe 212 in the second purge passage 210 is connected further to the intake upstream side than the compressor 231 in the intake pipe 123. In this way, the second branch pipe 203 of the first purge passage 200 communicates with the intake pipe 123. The second check valve 45 is provided on the pathway of the second purge pipe 212. In the second purge pipe 212, the second pressure sensor 46 as the pulsation detection sensor is provided further on the intake pipe 123 side than the second check valve 45.

In the internal combustion engine 230, intake air flowing through the intake pipe 123 is pressure-fed to the surge tank 122 according to the driving of the compressor 231. For this reason, on the intake downstream side of the compressor 231 in the intake pipe 123, there is also a case where the pressure in the intake pipe 123 does not become a negative pressure. In a case where a negative pressure is not generated in the intake pipe 123, there is also a case where the purge gas cannot flow from the canister 20 to the intake pipe 123 through the first purge passage 200 and the second purge passage 210. In the configuration shown in FIG. 8, the electronic control unit 60 controls the driving of the first purge control valve 204 and the second purge control valve 205 according to the driving of the compressor 231. That is, in a case where the purge execution condition is satisfied, the electronic control unit 60 opens the second purge control valve 205 while closing the first purge control valve 204 by the drive unit 61 when the compressor 231 is being driven. In this case, as described above, the drive unit 61 drives the second purge control valve 205 so as to open and close the second purge control valve 205, with the calculated duty ratio D. When the compressor 231 is being driven, the pressure further on the intake downstream side than the compressor 231 in the intake pipe 123 increases, while a negative pressure is generated further on the intake upstream side than the compressor 231. For this reason, the second purge control valve 205 is driven to be opened and closed, whereby the purge gas flows from the canister 20 to the second purge pipe 212 of the second purge passage 210 through the main pipe 201 of the first purge passage 200 and the second branch pipe 203, and the purge gas is discharged to the intake pipe 123. The purge gas discharged to the intake pipe 123 flows to the surge tank 122 together with the intake air and is supplied to each combustion chamber through each of the branch pipes 124.

In a case where the purge execution condition is satisfied, the electronic control unit 60 opens the first purge control valve 204 while closing the second purge control valve 205 by the drive unit 61 when the compressor 231 is not driven. When the compressor 231 is not driven, a negative pressure is generated further on the intake downstream side than the throttle valve 125 in the intake pipe 123. For this reason, the first purge control valve 204 is driven to be opened and closed, whereby the purge gas flows from the canister 20 to the first purge pipe 211 of the second purge passage 210 through the main pipe 201 of the first purge passage 200 and the first branch pipe 202, and the purge gas is discharged to the intake pipe 123. The purge gas discharged to the intake pipe 123 flows to the surge tank 122 together with the intake air and is supplied to each combustion chamber through each of the branch pipes 124.

As described above, when the drive unit 61 of the electronic control unit 60 opens the purge control valves 204, 205 according to the driving situation of the compressor, the purge gas flows from the canister 20 to the intake pipe 123 through the first purge passage 200 and the second purge passage 210. When the drive unit 61 of the electronic control unit 60 closes the purge control valves 204, 205, the flow of the purge gas through the first purge passage 200 and the second purge passage 210 is stopped. For this reason, when abnormality such as clogging or disengagement has not occurred in the second purge passage 210, pulsation of the purge gas occurs in the first purge pipe 211 and the second purge pipe 212 of the second purge passage 210 due to the flow of the purge gas associated with the opening and closing drive of the purge control valves 204, 205. On the other hand, if abnormality occurs in the first purge pipe 211 of the second purge passage 210, even if the first purge control valve 204 is driven to be opened and closed, it is difficult for a change to occur in the flow of the purge gas in the first purge pipe 211. If abnormality occurs in the second purge pipe 212 of the second purge passage 210, even if the second purge control valve 205 is driven to be opened and closed, it is difficult for a change to occur in the flow of the purge gas in the second purge pipe 212.

Therefore, also in the configuration shown in FIG. 8, the pulsation of the purge gas in the first purge pipe 211 when the first purge control valve 204 is driven to be opened and closed is detected by the first pressure sensor 44, and the pulsation of the purge gas in the second purge pipe 212 when the second purge control valve 205 is driven to be opened and closed is detected by the second pressure sensor 46. Then, by detecting the pulsation of the purge gas in the first purge pipe 211 and the second purge pipe 212, it is possible to detect the occurrence of abnormality in the second purge passage 210 in the evaporated fuel treating device.

In the configuration shown in FIG. 1 or the configuration shown in FIG. 7, it is also possible to dispose the compressor 231 in the intake passage. In the configuration shown in FIG. 1 or the configuration shown in FIG. 7, in a case where the second ends of the second purge passages 40, 110 are connected further to the intake downstream side than the compressor 231 in the intake passage, when the driving of the compressor 231 is stopped, the purge control valve 31 is driven to be opened and closed, whereby pulsation due to the flow of the purge gas occurs in the second purge passages 40, 110. In a case where the second ends of the second purge passages 40, 110 are connected further to the intake upstream side than the compressor 231 in the intake passage, when a negative pressure is generated on the intake upstream side due to the driving of the compressor 231, the purge control valve 31 is driven to be opened and closed, whereby pulsation due to the flow of the purge gas occurs in the second purge passages 40, 110. Therefore, even with the configurations described above, it is possible to determine the abnormality of the second purge passages 40, 110, based on the pulsation of the purge gas.

In the above-described embodiment, an example in which the first pressure sensor 44 and the second pressure sensor 46 are provided as the pulsation detection sensor is shown. However, as the pulsation detection sensor, other sensors capable of detecting the pulsation of the purge gas in the second purge passages 40, 110, 210 may be adopted. In a case where pulsation occurs, the flow rate of the purge gas changes, and therefore, it is also possible to adopt, for example, a flow rate sensor as the pulsation detection sensor.

The purge control valves 31, 204, 205 are not limited to electromagnetic valves. For example, a so-called vacuum switching valve in which a valve body is driven to be opened and closed according to a negative pressure that is introduced can also be adopted.

What is claimed is:

1. An evaporated fuel treating device comprising:

a canister configured to adsorb evaporated fuel generated in a fuel tank;

a first purge passage having a first end connected to the canister;

a second purge passage connected to a second end of the first purge passage and making the first purge passage and an intake passage communicate with each other;

a purge control valve disposed in the first purge passage;

a pulsation detection sensor disposed in the second purge passage; and an electronic control unit configured to execute abnormality detection control that performs abnormality detection of the second purge passage, the electronic control unit being configured to execute control that opens and closes the purge control valve, the electronic control unit being configured to detect pulsation of a purge gas flowing through the second purge passage, based on an output signal from the pulsation detection sensor when the electronic control unit executes the control that opens and closes the purge control valve; and the electronic control unit being configured to determine abnormality of the second purge passage, based on the detected pulsation of the purge gas.

2. The evaporated fuel treating device according to claim 1, wherein:

the second purge passage has a plurality of branch passages;

each of the branch passages has one end that is connected to the second end of the first purge passage, and the other end that is connected to the intake passage;

a check valve and the pulsation detection sensor are provided in each of the branch passages;

the check valve is configured to allow a flow of the purge gas toward the intake passage side and limit the flow of the purge gas toward the first purge passage side;

the pulsation detection sensor is disposed further on the intake passage side than the check valve;

the electronic control unit is configured to detect pulsation of the purge gas in each of the branch passages, based on an output signal from the pulsation detection sensor when the electronic control unit executes the control that opens and closes the purge control valve; and the electronic control unit is configured to determine abnormality in each of the branch passages, based on the detected pulsation of the purge gas in each of the branch passages.

3. The evaporated fuel treating device according to claim 1, wherein the electronic control unit includes a bandpass filter configured to pass solely an output signal having a frequency range corresponding to a frequency of an opening and closing drive signal of the purge control valve, among output signals from the pulsation detection sensor.

4. The evaporated fuel treating device according to claim 1, wherein:

the electronic control unit is configured to calculate a front-side pressure that is a pressure further on the canister side than the purge control valve in the first purge passage;

the electronic control unit is configured to calculate a rear-side pressure that is a pressure further on the second purge passage side than the purge control valve in the first purge passage; and the electronic control unit is configured to start the abnormality detection control when the electronic control unit determines that a differential pressure between the calculated front-side pressure and the calculated rear-side pressure is equal to or higher than a predetermined pressure.

5. The evaporated fuel treating device according to claim 1, wherein:

the electronic control unit is configured to open and close the purge control valve by controlling a duty ratio of a drive signal to the purge control valve; and the electronic control unit is configured to determine whether to execute the abnormality detection control according to the duty ratio.

6. The evaporated fuel treating device according to claim 1, wherein:

the electronic control unit is configured to calculate a front-side pressure that is a pressure further on the canister side than the purge control valve in the first purge passage;

the electronic control unit is configured to calculate a rear-side pressure that is a pressure further on the second purge passage side than the purge control valve in the first purge passage;

the electronic control unit is configured to determine that the second purge passage is in abnormal state, when an amplitude of the detected pulsation of the purge gas is equal to or less than a determination value; and the larger the differential pressure between the calculated front-side pressure and the calculated rear-side pressure is, the larger the determination value is.

7. The evaporated fuel treating device according to claim 1, wherein:

the electronic control unit is configured to execute the control that opens and closes the purge control valve by controlling a duty ratio of a drive signal to the purge control valve;

the electronic control unit is configured to determine that the second purge passage is in abnormal state, when an amplitude of the detected pulsation of the purge gas is equal to or less than a determination value; and the determination value becomes a largest value when the duty ratio is a predetermined ratio, and becomes a smaller value as the duty ratio deviates from the predetermined ratio.

8. A vehicle comprising:

an internal combustion engine; and an evaporated fuel treating device that includes a canister, a first purge passage, a second purge passage, a purge control valve, a pulsation detection sensor, and an electronic control unit, the canister being configured to adsorb evaporated fuel generated in a fuel tank, the first purge passage having a first end connected to the canister, the second purge passage being connected to a second end of the first purge passage and makes the first purge passage and an intake passage communicate with each other, the purge control valve being disposed in the first purge passage, the pulsation detection sensor being disposed in the second purge passage, the electronic control unit being configured to start abnormality detection control when an operation state of the internal combustion engine is in an idle operation, the electronic control unit being configured to execute control that opens and closes the purge control valve;

the electronic control unit being configured to detect pulsation of a purge gas flowing through the second purge passage, based on an output signal from the pulsation detection sensor when the electronic control unit executes the control that opens and closes the purge control valve, and the electronic control unit being configured to determine abnormality of the second purge passage, based on the detected pulsation of the purge gas.

* * * * *